US005760536A

United States Patent [19]

Susukida et al.

[11] Patent Number: 5,760,536

[45] Date of Patent: Jun. 2, 1998

[54] COLD CATHODE ELECTRON SOURCE ELEMENT WITH CONDUCTIVE PARTICLES EMBEDDED IN A BASE

[75] Inventors: Masato Susukida; Jun Hagiwara, both of Chiba; Katsuto Nagano, Kanagawa, all of Japan

[73] Assignee: TDK Corporation, Tokyo, Japan

[21] Appl. No.: 347,133

[22] Filed: Nov. 23, 1994

[30] Foreign Application Priority Data

| | | | |
|---|---|---|---|
| Nov. 24, 1993 | [JP] | Japan | 5-293357 |
| Mar. 31, 1994 | [JP] | Japan | 6-063536 |
| Jun. 27, 1994 | [JP] | Japan | 6-144545 |

[51] Int. Cl.[6] ..... H01J 1/30

[52] U.S. Cl. ..... 313/311; 313/310; 313/309; 313/351; 313/495

[58] Field of Search ..... 313/311, 310, 313/309, 346 R, 346 DC, 351, 633, 491, 630, 495, 497

[56] References Cited

U.S. PATENT DOCUMENTS

| | | | |
|---|---|---|---|
| 4,325,000 | 4/1982 | Wolfe et al. | 313/346 R |
| 4,498,952 | 2/1985 | Christensen | 313/309 X |
| 4,663,559 | 5/1987 | Christensen . | |
| 5,019,003 | 5/1991 | Chason | 313/309 X |
| 5,066,883 | 11/1991 | Yoshioka et al. | 313/309 |
| 5,141,460 | 8/1992 | Jaskie et al. | 313/309 X |

FOREIGN PATENT DOCUMENTS

| | | | |
|---|---|---|---|
| 0 572 777 | 12/1993 | European Pat. Off. . | |
| 0297035 | 12/1991 | Germany | 313/311 |
| 63-274047 | 11/1988 | Japan . | |
| 1 200532 | 8/1989 | Japan . | |
| 2 220337 | 9/1990 | Japan . | |
| 3 49129 | 3/1991 | Japan . | |
| 3 252025 | 11/1991 | Japan . | |
| 4138636 | 5/1992 | Japan | 313/311 |
| 6 89652 | 3/1994 | Japan . | |
| 6 196086 | 7/1994 | Japan . | |
| 1 466 534 | 3/1977 | United Kingdom . | |

*Primary Examiner*—Ashok Patel

*Attorney, Agent, or Firm*—Oblon, Spivak, McClelland, Maier & Neustadt, P.C.

[57] ABSTRACT

A cold cathode electron source element having a cold cathode on a substrate. The cold cathode has dispersed in a cold cathode base particles of a conductive material having a lower work function than the base and a particle size which is sufficiently smaller than the thickness of the cold cathode. The element can be driven with a low voltage to induce high emission current in a stable manner. The cold cathode is easily processable. The element can have an increased surface area.

11 Claims, 21 Drawing Sheets

COLD CATHODE ELECTRON SOURCE ELEMENT WITH CONDUCTIVE PARTICLES EMBEDDED IN A BASE

BACKGROUND OF THE INVENTION

1. Field of the Invention

This invention relates to a cold cathode electron source element and a method for manufacturing the same.

2. Background Art

Field emission type electron sources can be manufactured to,a micron size by virtue of semiconductor micro-processing technology and are easy to integrate and process batchwise. They are expected to find application in GHz band amplifiers and high-power/high-speed switching elements, to which thermionic emission type electron sources could not be applied, as well as electron sources for high definition flat panel displays. Active research and development efforts have been made thereon over the world Prior art examples of the field emission type electron source are described below. Japanese Patent Application Kokai (JP-A) No. 274047/1988 proposes a thin film field emission type electron source which includes, as shown in FIG. 35, a cold cathode 52 and an opposing gate electrode 53 deposited on an insulator substrate 51 with a spacing of 0.3 to 2 μm wherein a voltage is applied across the cold cathode 52 and the gate electrode 53 in vacuum to induce electron emission. This cold cathode 52 is formed using a FI (focused ion beam) technique, especially with the end of convergent fingers being sharply pointed. The FIB technique used herein, however, makes it difficult to manufacture an element having an electron source array over a large surface area and increases the manufacturing cost.

When a large surface area and manufacturing cost are taken into account, on the other hand, patterning by photolithography is deemed appropriate. However, the current photolithography is limited to a patterning diameter of the order of 0.5μm since the diameter of an electron beam spot is the minimum patterning diameter. As a consequence, in order to form the cold cathode 52 with sharply pointed fingers, various additional steps must be taken. As the number of steps increases, the possibility of damaging the element, especially its cold cathode finger tips increases, which causes a lowering of the manufacturing yield of elements. Most of the cold cathode sharpening steps are complex and difficult to control the shape.

JP-A 49129/1991 proposes a thin film field emission type electron source in which as shown in FIG. 36, a cold cathode 63 and a gate electrode 64 are formed parallel on the surface of an insulating layer 62 on an insulator substrate 61 by a cleavage and fracture process using ultrasonic wave. The thin film field emission type electron source shown in FIG. 36, however, has the problems that because of the concomitant ultrasonic fracture, formation of the cold cathode 63 to a uniform shape is technically difficult and the thin film from which the cold cathode 63 is formed receives substantial damages.

JP-A 252025/1991 proposes a thin film field emission type electron source in which as shown in FIGS. 37 and 38, a cold cathode 73 having a plurality of convergent fingers are formed on an insulating layer 72 on an insulator substrate 71 by a photo-etching technique and thereafter, the convergent fingers at their tip are sharply pointed utilizing an isotropic etching technique. It is noted that 74 in FIG. 37 is a gate electrode 74 opposed to the cold cathode 73. In this electron source, however, it is difficult to control the shape of the cold cathode 73 by a choice of etching conditions. The process is not applicable where no undercutting takes place due to formation of a side wall protecting film or some other reasons.

Also JP-A 220337/1990 discloses to coat the cold cathode 73 on its surface with a transition metal carbide, metal oxide or rare earth oxide that is a low work function material which is chemically stable and likely to emit electrons into vacuum. However, it is difficult to limit such coating to the cold cathode 73 and the like.

As mentioned above, in the case of prior art field emission electron sources, the shape of a cold cathode including pointing of cold cathode finger, tips could not be properly defined and it was impossible to use a low work function, chemically stable material as the cold cathode because of difficulty of micro-processing. These undesirably inhibited manufacture of a stable field emission electron source having satisfactory properties.

U.S. Pat. No. 5,019,003 discloses a field emitting device having a plurality of preformed emitter (or cold cathode) particles distributed on a support. In this device, as shown in FIG. 39, a plurality of conductive objects 201 are distributed on a support substrate 100, the conductive objects 201 being coupled to the substrate 100 by a bonding agent 101. The conductive objects 201 may be of molybdenum, titanium carbide or the like, preferably have geometrically sharp edges, and function as emitters. It is described that instead of or in addition to the conductive objects 201, insulating objects 203 may be used as shown in the figure and in such a case, the insulating objects 203 are coated with a conductive thin layer 202 for practical use. A layer of the bonding agent 101 has a thickness of about 0.5 μm, and the conductive objects 201 and the coating of the insulating object 203 with the conductive thin layer 202 have a length (or maximum dimension) of about 1.0 μm so that a sufficient quantity of the conductive objects 201 are exposed. An actual field emitting device is assembled by adding an anode and a gate to the emitter section.

The resulting field emitting device is shown in FIG. 40 wherein an insulating layer 409 is formed on the support 100 having a plurality of emitter objects 201 borne thereon, with some of the emitter objects 201 left uncovered. On the insulating layer 409 is formed a conductive layer 401 functioning as a gate for adjusting electron flow. On the conductive layer 401 is formed an insulating layer 402. Disposed on the insulating layer 402 is a screen 404 having an anode function too. A luminescent layer 403 is formed on that side of the screen 404 which faces the emitter objects 201. The screen 404 is coupled in vacuum as by soldering, with the encapsulated areas 406 being evacuated. Voltage application causes the emitter objects 201 to emit electrons and by the action of emitted electrons, light emission 408 occurs through the screen 404.

In the device disclosed in this patent, since there are some sites where the emitter objects 201 are in contact with the insulating layer 409 as is evident from FIG. 40, on voltage application, the voltage can concentrate at the insulating layer 409, increasing the risk of breakage. If the insulating layer 409 is made thick in order to prevent such breakage, the voltage applied for electron emission must be undesirably increased.

DISCLOSURE OF THE INVENTION

An object of the present invention is to provide a cold cathode electron source element which can be driven with a low voltage to provide high emission current in a stable manner, is improved in processing of the cold cathode, and can have an increased surface area as well as a method for manufacturing the same.

This and other objects are achieved by the present invention which is defined below as (1) to (16)

(1) A cold cathode electron source element having a cold cathode, the cold cathode comprising a cold cathode base and particles of a conductive material dispersed and contained in the base and having a lower work function than the base and a particle size which is less than the thickness of the cold cathode, the particles being dispersed in a substantially discrete relationship and exposed at a surface of the cold cathode.

(2) The cold cathode electron source element of (1) wherein the particles have a mean particle size of 0.5 nm to 50 nm as determined from X-ray diffractometry.

(3) The cold cathode electron source element of (1) wherein the particles have a mean particle size of 0.5 nm to 50 nm as measured by observation under a transmission electron microscope.

(4) The cold cathode electron source element of (1) wherein the particles are contained in an amount of 1 to 50% by volume based on -he cold cathode base.

(5) The cold cathode electron source element of (1) wherein the particles protrude from the surface of the cold cathode.

(6) The cold cathode electron source element of (1) wherein the cold cathode is obtained by depositing a component for the cold cathode base and a component for the conductive material by a vapor phase technique.

(7) The cold cathode electron source element of (6) wherein the cold cathode is prepared by the steps of forming an amorphous or microcrystalline cold cathode-forming conductor layer and effecting heat treatment on the cold cathode-forming conductor layer.

(8) The cold cathode-electron source element of (7) wherein the heat treatment is effected at a temperature in the range from a film depositing temperature to 700° C.

(9) The cold cathode electron source element of (6) wherein the cold cathode is prepared by alternately depositing a thin layer of a component to constitute the cold cathode base and a thin layer of a component to constitute the conductive material particles to thereby form a cold cathode-forming conductor layer.

(10) The cold cathode electron source element of (9) wherein the thin layer of a component to constitute the conductive material particles has a thickness of 0.5 nm to 50 nm.

(11) The cold cathode electron source element of (9) wherein after the cold cathode-forming conductor layer is formed, the cold cathode-forming conductor layer is heat treated at a temperature in the range from a film depositing temperature of the cold cathode-forming conductor layer to 700° C.

(12) A method for preparing a cold cathode electron source element having a cold cathode, the cold cathode comprising a cold cathode base and particles of a conductive material dispersed and contained in the base and having a lower work function than the base and a particle size which is less than the thickness of the cold cathode, the particles being dispersed in a substantially discrete relationship and exposed at a surface of the cold cathode, the method comprising the steps of forming an amorphous or microcrystalline cold cathode-forming conductor layer and effecting heat treatment on the cold cathode-forming conductor layer.

(13) The method of (12) wherein the heat treatment is effected at a temperature in the range from a film depositing temperature to 700° C.

(14) A method for preparing a cold cathode electron source element having a cold cathode, the cold cathode comprising a cold cathode base and particles of a conductive material dispersed and contained in the base and having a lower work function than the base and a particle size which is less than the thickness of the cold cathode, the particles being dispersed in a substantially discrete relationship and exposed at a surface of the cold cathode, the method comprising the steps of alternately depositing a thin layer of a component to constitute the cold cathode base and a thin layer of a component to constitute the conductive material particles to thereby form a cold cathode-forming conductor layer.

(15) The method of (14) wherein the thin layer of a component to constitute the conductive material particles has a thickness of 0.5 nm to 50 nm.

(16) The method of (14) wherein after the conductor layer for the cold cathode is formed, the cold cathode-forming conductor layer is heat treated at a temperature in the range from a film depositing temperature of the cold cathode-forming conductive layer to 700° C.

Function

In the cold cathode electron source element of the invention, a cold cathode on a substrate has dispersed and contained in a cold cathode base a conductive material which has a lower work function than the base and is in the form of particles having a particle size sufficiently smaller than the thickness of the cold cathode. The element allows for emission of electrons with a low voltage and offers a high emission current. Since the cold cathode base can be processed by a conventional photo-process and etching, it can be simply configured to any desired shape and the cold cathode electron source element can be increased in surface area. Also since the conductive material particles are dispersed in an exposed or protruding state with respect to the surface of the cold cathode, the concentration of an electric field allows electrons to be extracted with a low voltage to produce a high emission current.

The conductive material particles with a smaller mean particle size have advantages of a high emission current, creation of a multiplicity of electron emitting points, and a stable emission current behavior.

These eliminate a need for a complex process for shaping the cathode so as to have pointed tips with a small curvature radius as required in the prior art.

Fabrication of the cold cathode is facilitated by forming an amorphous or microcrystalline cold cathode-forming conductor layer containing an element to constitute the cold cathode base and an element to constitute the conductive material and heat treating the conductor layer. The cold cathode base and the conductive material are both enhanced in crystallinity. The enhanced crystallinity of the cold cathode base accompanies the increased purity of the cold cathode base and allows for easier etching within a shorter time, so that the processability of the cold cathode base is substantially improved and the manufacturing cost is reduced. Also the enhanced crystallinity of the conductive material allows for electron extraction with a low voltage for producing a stable high emission current flow. By separating the film deposition step and the heat treatment step, a high manufacturing efficiency is achieved.

In the embodiment wherein a thin layer of an element(s) to constitute the cold cathode base and a thin layer of a element(s) to constitute the conductive material particles are alternately deposited to form a cold cathode-forming conductor layer and the cold cathode-forming conductor layer is then processed into a cold cathode, the particle size of the conductive material particles can be controlled in terms of the thickness of the thin layer of the element(s) to constitute the conductive material particles and thus preparation of the cold cathode becomes easier. More specifically, in the embodiment wherein the thickness of a thin layer of element (s) to constitute the conductive material particles is set within a specific range, since this thin layer has an island structure rather than a continuous film structure, it is possible to form a cold cathode-forming conductor layer having a structure wherein the conductive material particles are substantially dispersed in the cold cathode base.

The cold cathode-forming conductor layer can be readily etched with an etchant for the cold cathode base, thereby forming a cold cathode. At the same time, a structure wherein the conductive material particles are exposed at or protrude from the etched section of the cold cathode can be consistently formed in a reproducible manner. Then a cold cathode electron source element which can be driven with a low voltage and produce high emission current in a stable manner can be manufactured in high yields.

Moreover, where the cold cathode-forming conductor layer is further heat treated, the cold cathode base and conductive material particles are increased in crystal grain size and the element(s) to constitute the conductive material particles which is incorporated into the cold cathode base as an impurity and the element(s) to constitute the cold cathode base which is incorporated into the conductive material particles as an impurity precipitate at grain boundaries, resulting in a substantial increase of the dispersity of the conductive material particles in the cold cathode-forming conductor layer. As a result, when the cold cathode is formed, the etching rate associated with chemical etching can be increased. Furthermore, since the mean particle size of the conductive material particles is uniformed approximately to the thickness of a thin layer of the element(s) to constitute the conductive material particles, a cold cathode electron source element capable of uniform electron emission over an increased area can be formed

ILLUSTRATIVE CONSTRUCTION

Now the illustrative construction of the present invention is described in detail.

The cold cathode electron source element of the present invention has a cold cathode base on an insulating substrate and a conductive material as an emitter substance is dispersed in the cold cathode base as a matrix to form a cold cathode. The conductive material used herein is in the form of microparticulate or submicron particles having a particle size which is sufficiently smaller than the thickness of the cold cathode itself. Individual particles are dispersed in a substantially discrete relationship and exposed at the surface of the cold cathode. The conductive material used is one having a lower work function than the cold cathode base.

This element construction eliminates complex processing steps, enables to extract electrons at a low voltage, and produces a high emission current flow. In contrast, if the conductive material particles have a particle size which is greater than the thickness of the cold cathode, microprocessing of the cold cathode becomes difficult and the likelihood of short-circuiting between the cold cathode and the gate electrode increases. If the relationship of work function between the two materials is other than the above-defined, the advantages of the invention are lost.

Figure 1:
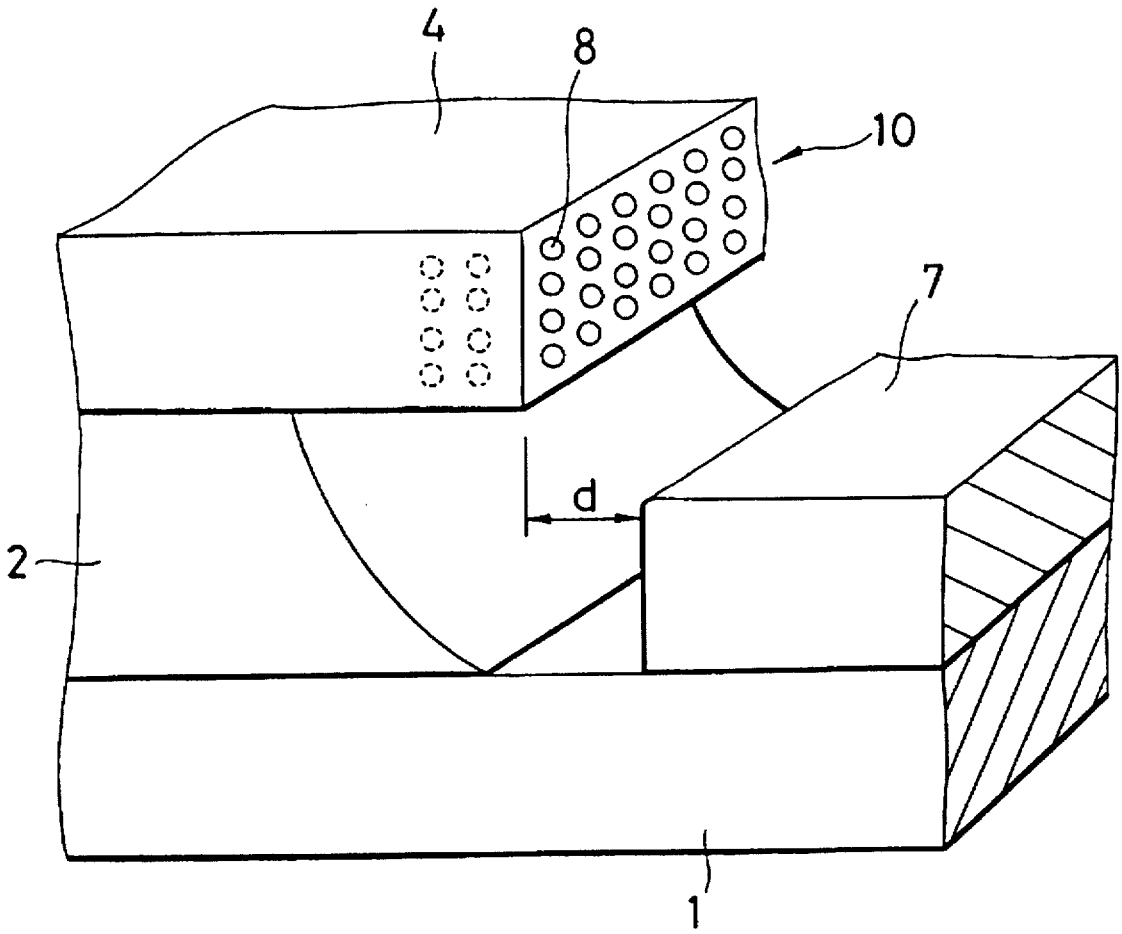
FIG. 1 is a fragmental enlarged perspective view of a cold cathode electron source element according to one embodiment of the invention

One exemplary arrangement of such a cold cathode electron source element is illustrated in FIG. 1. The cold cathode electron source element shown in FIG. 1 includes an insulating layer 2 on the surface of an insulating substrate 1, a cold cathode or emitter 10 on the insulating layer 2, and a gate electrode 7 formed in close proximity to the cold cathode 10. The cold cathode 10 is formed of a cold cathode base 4 having dispersed and contained therein conductive submicron particles 8 of a conductive material as described above.

In order to manufacture a cold cathode electron source element having satisfactory performance, the conductive submicron particles 8 having as small a particle size as possible are formed using a chemically stable material having a low work function as mentioned above and a design of arrangement is made such that the cold cathode 10 may be closely spaced from the gate electrode 7.

Desirably the conductive submicron particles 8 used herein have a particle size of 0.5 to 50 nm, preferably 0.5 to 20 nm, more preferably 1 to 10 nm as determined from the highest orientation peak in an X-ray diffractometry (XRD) spectrum according to Scherrer's equation. Also an observation under a transmission electron microscope (TEM) reveals that when a film is properly deposited, the conductive submicron particles in primary particle form are present at the grain boundary of the cold cathode base component. Desirably the primary particles have a number average particle size of 0.5 to 50 nm, preferably 0.5 to 20 nm, more preferably 1 to 10 nm as determined from a TEM photograph. It is to be noted that on a TEM observation, secondary particles which are agglomerates of primary particles (agglomerate structures such as spherical and island agglomerates) can be found under certain film deposition conditions although it is preferred that the particles be present as discrete single particles (or primary particles).

Preferably the conductive submicron particles 8 are uniformly dispersed in the cold cathode base 4, ensuring high emission current. Also preferably the conductive submicron particles 8 are dispersed such that they are exposed at or protrude from the surface of the cold cathode 10 as shown in the figure. Such a dispersion allows for concentration of an electric field which enables to extract electrons with a low voltage and provide high emission current. It is understood that the conductive submicron particles 8 are exposed at the surface of the cold cathode 10, but usually protrude from the surface as a result of etching which will be described later.

Further the distance d between the cold cathode 10 and the gate electrode 7 (see FIG. 1 as well as FIGS. 6, 10 and 19 which will be explained later) is preferably about 0.1 to about 20 μm.

For the conductive submicron particles 8, use is made of a material which is chemically stable and has a sufficiently low work function to readily emit electrons into vacuum. More particularly, there are used metal carbides such as TiC, ZrC, HfC, TaC, NbC, MoC, and WC; metal nitrides such as TaN, TiN, ZrN, and HfN; rare earth metal borides and transition metal borides such as $LaB_6$, TaB, $TiB_2$, $ZrB_2$, and $HfB_2$; diamond; conductive carbon such as graphite; and materials containing at least one of them.

The material used as the cold cathode base 4 is selected from good conductor materials unsusceptible to carbonization such as Ag, Cu, Ni, Al, and Cr if the conductive submicron particles 8 are of carbides; good conductor materials unsusceptible to nitridation such as Ag, Cu, Ni, and Cr if the conductive submicron particles 8 are of nitrides; good conductor materials unsusceptible to boride formation such as Ag, Cu, and Cr if the conductive submicron particles 8 are of borides; or materials containing at least one of these examples. With respect to a preferred combination of such a conductive material and a cold cathode base, where the two materials are alternately deposited by ion plating or reactive sputtering or a film of a mixture of the two materials is similarly deposited and heat treated as will be described later, few limit is imposed on the cold cathode base material, various materials may be used therefor, and the two material may have a common metal element. In the practice of the invention, it is preferred to use a metal carbide as the conductive material.

As previously described, the conductive material of which conductive submicron particles 8 are formed should have a work function which is lower than the work function of the material of which the cold cathode base 4 is formed. More particularly, as physical values of matter, the conductive material should preferably have a work function of up to 4.0 eV, more preferably 1.0 to 4.0 eV whereas the cold cathode base material should preferably have a work function of at least 3.8 eV, more preferably 3.9 to 5 eV. Among such materials, a choice is made such that the difference in work function between the two materials is at least 0.2 eV, preferably about 0.4 to 4.0 eV.

It is to be noted that the work function used herein is the magnitude of minimum work needed to remove an electron from a solid into vacuum and is determinable by X-ray photoelectron spectrometry (XPS) and ultraviolet photoelectron spectrometry (UPS). The work functions of various materials are described in the literature, for example, V.S. Fomenko, Handbook of Thermionic Properties, PLENUM PRESS DATA DIVISION N.Y., 1966.

The conductive material and the cold cathode base material should preferably have a resistivity in bulk form of $1\times10^{-5}$ Ωcm to 1 Ωcm and up to $1\times10^{-4}$ Ωcm (often from $1\times10^{-6}$ Ωcm to $1\times10^{-4}$ Ωcm), respectively.

The proportion of the conductive submicron particles 8 relative to the cold cathode base 4 is preferably 1 to 50% by volume, more preferably 3 to 45% by volume, especially 5 to 30% by volume, most preferably up to 25% by volume.

With such a proportion, the advantages of the invention become more prominent. In contrast, if the proportion of the conductive submicron particles 8 is low, the population of the conductive submicron particles 8 of TiC or the like protruding from the end surface of the cold cathode 10 processed by etching as will be described later decreases, resulting in electron emission properties equivalent to a cold cathode substantially free of conductive submicron particles. On the other hand, if the proportion of the conductive submicron particles 8 is too high, dispersion among conductive submicron particles 8 is exacerbated to prohibit etching of the cold cathode base 4 and concentration of an electric field at individual conductive submicron particles 8.

Further the cold cathode 10 preferably has a thickness of 100 to 2,000 nm, especially 300 to 1,000 nm. With such a thickness, the advantages of the invention become more prominent. In contrast, if the cold cathode is too thin, the probability of disconnection increases. If the cold cathode is too thick, an etching process requires a long time, resulting in an increased cost and a loss of processing precision.

The material of which the insulating substrate 1 is formed according to the invention includes various glasses, silicon wafers, and various ceramics such as alumina. The size of the substrate may be properly selected in accordance with a particular purpose and application although its thickness may be about 0.3 to 5.0 mm.

In the arrangement of FIG. 1, the cold cathode 10 is disposed on the insulating substrate 1 with the insulating layer 2 interposed therebetween. The insulating layer 2 may be formed of an insulating material such as $SiO_2$, $Ta_2O_5$, $Y_2O_3$, MgO, and $Si_3N_4$ and have a thickness of about 0.2 to 2.0 μm. Also the gate electrode 7 may be formed of a metal such as Cr, Ho, Ti, Nb, Zr, Hf, Ta, Al, Ni, Cu, and W or an alloy thereof and have a thickness of about 0.1 to 1.0 μm.

Figure 2:
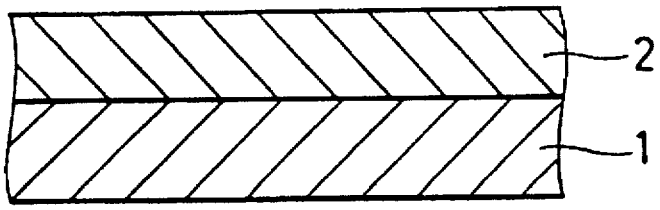
FIG. 2 is a cross-sectional view showing a process for manufacturing the cold cathode electron source element of FIG. 1.

Described below is a method of preparing the cold cathode electron source element shown in FIG. 1. First, as shown in FIG. 2, an insulating layer 2 is formed on the surface of an insulating substrate 1 to a predetermined thickness. The insulating layer 2 may be deposited as by sputtering.

Figure 3:
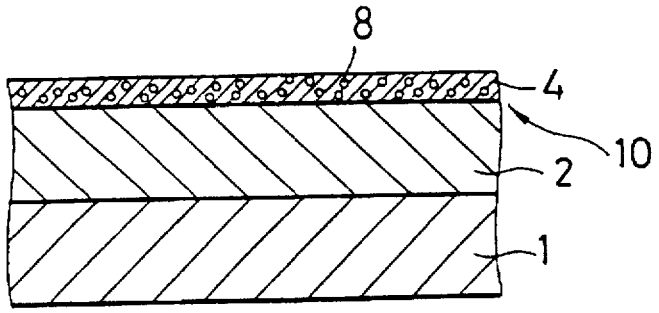
FIG. 3 is a cross-sectional view showing a process for manufacturing the cold cathode electron source element of FIG. 1.

Next, as shown in FIG. 3, a thin film in which conductive submicron particles 8 are finely dispersed in a cold cathode base 4 is formed to a predetermined thickness, obtaining a cold cathode 10. The cold cathode 10 may be formed by any vacuum thin film deposition process such as ion plating, sputtering and evaporation, with reactive ion plating and co-sputtering processes being preferred.

For deposition by the reactive ion plating process, the substrate is set at a temperature of about 100° to 500° C., an evaporation source of an alloy or the like corresponding to the cold cathode base 4 and conductive submicron particles 8 is used and heated by electron beams while a gas is introduced as a carbon, nitrogen or boron source, if necessary. The gas used as a C source may be a reactive gas such as $C_2H_2$, $C_2H_4$, $C_2H_6$, and $CH_4$; the gas used as an N source may be a reactive gas such as $NH_3$, $N_2$, and $N_2H_2$; and the gas used as a B source may be a reactive gas such as $B_2H_6$. The gas pressure used herein may range from about $1.0\times10^{-2}$ Pa to about 0.2 Pa, the probe current for ionization is about 1 to 5 A, and the substrate-hearth bias voltage is about 1 to 5 kV.

Figure 8:
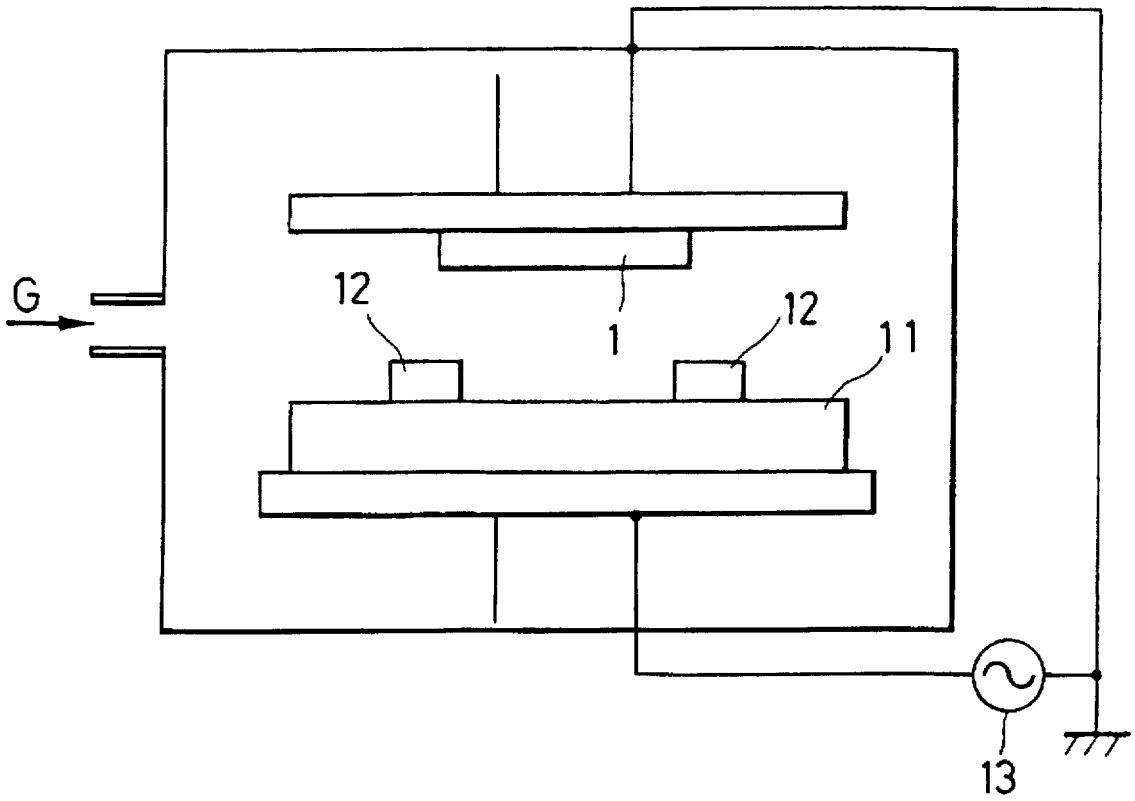
FIG. 8 is a schematic view showing one exemplary co-sputtering apparatus used in the present invention.

For deposition by the co-sputtering process, a sputtering apparatus as shown in FIG. 8 is used. A chip 12 of a conductive micraparticulate material or its components is rested on a target 11 formed of a cold cathode base material such as Ni. An insulating substrate 1 (having an insulating layer 2 on its surface) is opposed to the target 11. In this case, the pressure is about 0.1 to 2.0 Pa, and depending on the material of conductive submicron particles 8 or the like, a reactive gas G may be optionally introduced into the atmosphere, for example, a hydrocarbon gas such as $CH_4$, $C_2H_6$, $C_2H_4$, and $C_2H_2$ serving as a carbon source, a nitride gas such as $N_2$, $NH_3$, and $N_2H_2$ serving as a nitrogen source, or a boride gas such as $B_2H_6$ serving as a boron source. A power supply 13 has an RF power of about 0.3 to 5 kW and the substrate temperature may be about 100° to 500° C. Also if necessary, a negative bias voltage of less than about 500 V may be applied on the anode side.

Figure 9:
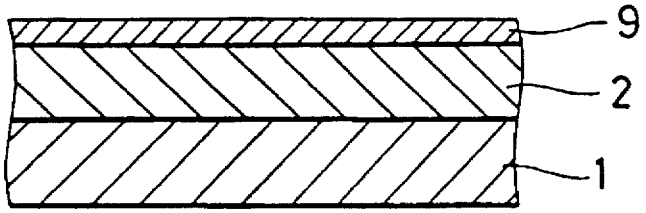
FIG. 9 is a cross-sectional view showing a manufacturing process wherein the cold cathode of the cold cathode electron source element of FIG. 1 is formed by heat treatment.

Alternatively, the cold cathode 10 may be obtained by forming an amorphous or microcrystalline cold cathode-forming conductor layer 9 and heat treating the conductor layer 9 as shown in FIG. 9. The cold cathode-forming conductor layer 9 used herein is composed of the components of the cold cathode base and the components of the conductive submicron particles and is preferably formed by a reactive co-sputtering process using the sputtering apparatus shown in FIG. 8. More particularly, reactive co-sputtering may be carried out with a target 11, chip 12 and insulating substrate 1 located as in the above-mentioned co-sputtering process. It is noted that the substrate is at a temperature of 0° to 100° C., especially near room temperature (about 15° to 30°C.) and the pressure is about 0.1 to 2.0 Pa. The atmosphere may be a mixture of an inert gas such as Ar and a reactive gas introduced therein as a C, N or B source to be introduced in accordance with the composition of the cold cathode 10. Its flow rate may be about 20 to 100 sccm as a whole and when the reactive gas is introduced, the inert gas such as Ar may occupy about 80 to 99%. The power supply 13 may have an RF power of about 0.3 to 3.0 kW.

The thus deposited cold cathode-forming conductor layer 9 is subject to heat treatment. This heat treatment causes the amorphous or microcrystalline cold cathode-forming conductor layer-9 to crystallize, forming a cold cathode in which conductive submicron particles 8 are finely dispersed in a cold cathode base 4 as shown in FIG. 3.

It can be confirmed from the results of X-ray diffractometry (XRD) or other analysis that the cold cathode-forming conductor layer 9 is amorphous or microcrystalline as deposited and crystallizes upon heat treatment.

The heat treatment method is not critical and may be selected from a heat treatment in vacuum using a resistance heating heater, a heat treatment in an inert gas such as Ar using a diffusion furnace, and a heat treatment using an excimer laser. Since the heat treatment becomes effective when the temperature is at or above the film deposition temperature, the heat treatment temperature may be from the film deposition temperature to 700° C., generally 250° to 700° C., further preferably 300° to 600° C. Too low heat treatment temperatures would render difficult wet etching using a nitric acid-phosphoric acid etching solution or the like which will be described later. This is probably because conductive submicron particles 8 do not fully grow and more impurities are left in the cold cathode base 4. These impurities are deemed to be unreacted materials, for example, Ti and C (inclusive of amorphous one) if the conductive submicron particles 8 are of TiC. If the heat treatment temperature is too high, the glass substrate would soften, resulting in deflection of the substrate or separation of the film therefrom, restraining element fabrication. Then inexpensive glass cannot be used as the substrate material and expensive-refractory materials such as quartz must be used.

The heat treatment time depends on the heat treatment temperature. With a higher temperature, the treatment time can be short. The above-mentioned temperature is generally maintained for ½ to 5 hours.

Figure 4:
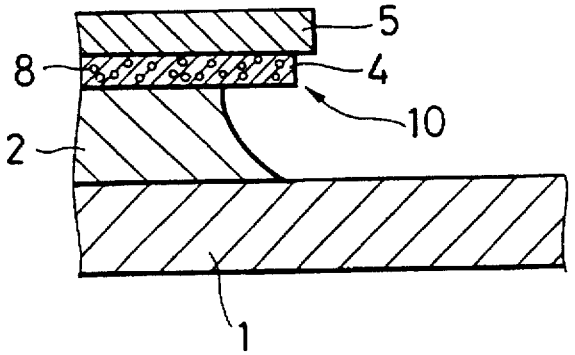
FIG. 4 is a cross-sectional view showing a process for manufacturing the cold cathode electron source element of FIG. 1.
Figure 5:
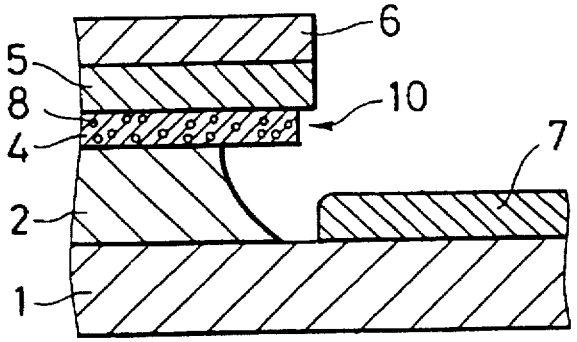
FIG. 5 is a cross-sectional view showing a process for manufacturing the cold cathode electron source element of FIG. 1.
Figure 6:
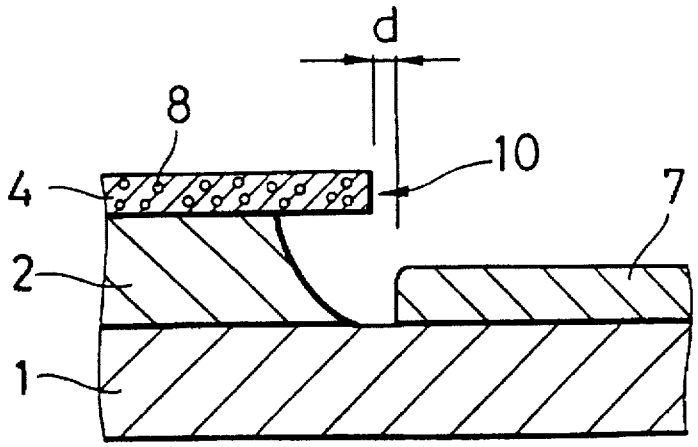
FIG. 6 is a cross-sectional view showing a process for manufacturing the cold cathode electron source element of FIG. 1.

Next, as shown in FIG. 4, after a resist 5 is formed on the cold cathode 10, the cold cathode 10 is configured by a photo-process and wet etching with an etching solution such as nitric acid-phosphoric acid solution. Further the insulating layer 2 is wet etched using an etching solution such as buffered hydrofluoric acid (BHF). At this point, the resist on the cold cathode 10 is left as such and not removed. Patterning of the cold cathode 10 by the photo-process is exemplified in FIG. 7. Further as shown in FIG. 5, a gate electrode 7 in the form of a Cr film and a film 6 of the same material as the gate electrode are formed over the entire surface to a predetermined thickness by evaporation or the like. Thereafter, as shown in FIG. 6, the resist 5 and the film 6 in the form of a Cr film are removed with a stripping solution.

Figure 10:
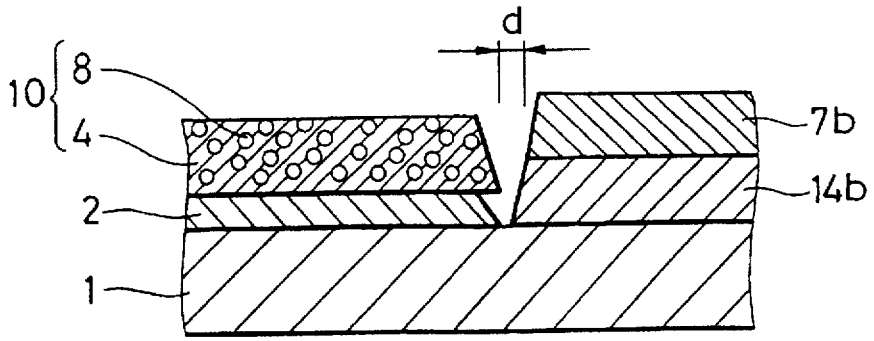
FIG. 10 is a cross-sectional view of a cold cathode electron source element according to another embodiment of the invention.

The cold cathode electron source element of the invention is not limited to the arrangement shown in FIG. 1, but may take the arrangement shown in FIG. 10. The cold cathode electron source element shown in FIG. 10 has the same structure as that shown in FIG. 1 except that the cold cathode 10 is prepared by a different method and that a gate electrode **7*b* is disposed on the substrate through a gate insulating layer 14*b***.

Figure 11:
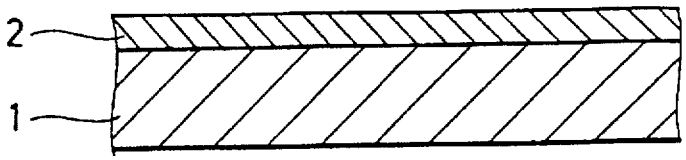
FIG. 11 is a cross-sectional view showing a process for manufacturing the cold cathode electron source element of FIG. 10.

The cold cathode 10 in this embodiment is prepared by alternately depositing a thin layer of an element to constitute the cold cathode base 4 and a thin layer of elements to constitute the conductive submicron particles 8 to thereby form a cold cathode-forming conductor layer, preferably effecting heat treatment, and processing the conductor layer. This preparation procedure eliminates the limitation that where the conductive submicron particles 8 are of a carbide or nitride, a good conductor material unsusceptible to carbonization or nitridation must be used as the material of the cold cathode base 4. Exemplary combinations of the material of the conductive submicron particles 8 and the material of the cold cathode base 4 include combinations of a carbide of a transition metal such as Ti, Zr, Nb, Ho, Hf, Ta and w with Cr, Ni, Cu, Al, Ti, Zr, Nb, Hf, Ta, W, etc., for example, combinations of TiC with Ti, TiC with No, and TaC with Mo; combinations of a nitride of a transition metal such as Ti, Zr, Nb, Ma, Hf, Ta and W with Cr, Ni, Cu, Al, Ti, Zr, Nb, Hf, Ta, W, etc., for example, combinations of TaN with Nb and ZrN with W; and combinations of a boride of a rare earth metal or transition metal such as La, Ce, Pr, Gd, Ti and Ta with Cr, Ni, Cu, Al, Ti, Zr, Nb, Hf, Ta, W, etc., for example combinations of $LaB_6$ with Mo, and TaB with Zr. It is to be noted that the gate insulating layer **14*b* in FIG. 10 may be formed of $SiO_2$ etc. like the other insulating layers and has a thickness of about 0.1 to 2.0 nm. The remaining components are the same as in FIG. 1. Described below is a method for preparing the cold cathode electron source element of FIG. 10. First, as shown in FIG. 11, an insulating layer 2 is formed on the surface of an insulating substrate 1** to a predetermined thickness by sputtering or the like.

Figure 12:
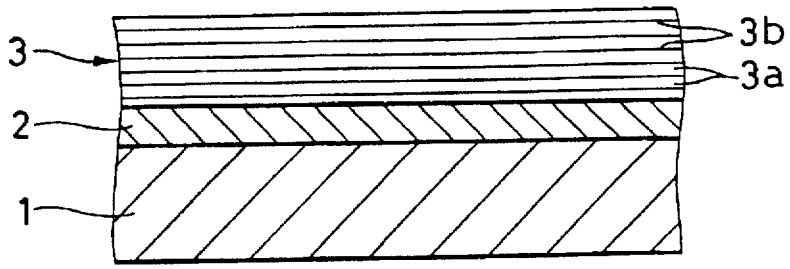
FIG. 12 is a cross-sectional view showing a process for manufacturing the cold cathode electron source element of FIG. 10.
Figure 17:
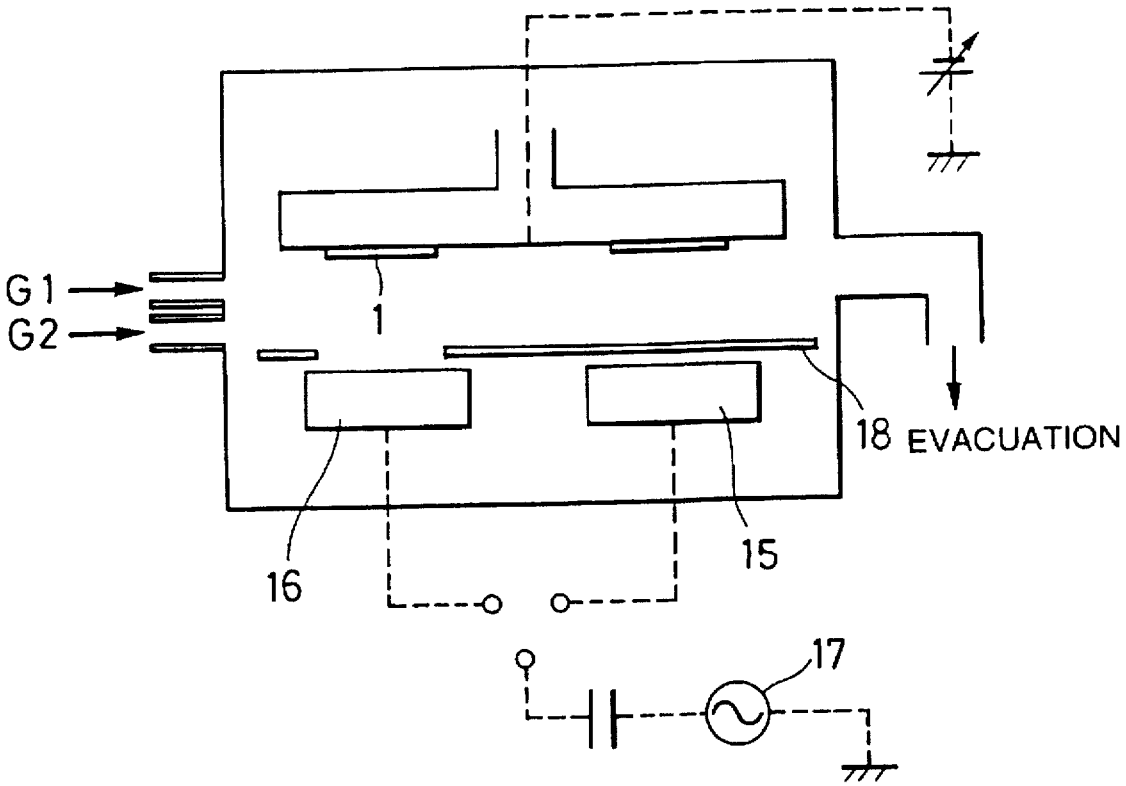
FIG. 17 is a schematic view showing one exemplary multi-source sputtering apparatus used in the present invention.

Next, as shown in FIG. 12, a thin layer **3*a* of an element to constitute the cold cathode base 4 and a thin layer 3*b* of elements to constitute the conductive submicron particles 8 are alternately deposited on the surface of the insulating layer 2 using a sputtering apparatus as shown in FIG. 17, the alternately deposited layers forming a cold cathode-forming conductor layer 3**.

For forming the alternately deposited layers, multi-source sputtering may be carried out, for example, by using a target 15 made of-the cold cathode base material such as Ni and a target 16 made of the conductive submicron particle material such as TiC or elements thereof as shown in FIG. 17. Opposed to the targets 15 and 16 is a turntable on which insulating substrates 1 (having an insulating layer on their surface) are rested. Deposition is effected while rotating the turntable.

Thin layers **3*a* of a component to constitute the cold cathode base 4 are formed by sputtering with only an inert gas G1 such as Ar introduced. And thin layers 3*b*** of components to constitute the conductive submicron particles B are formed by reactive sputtering with a reactive gas G2 such as a hydrocarbon introduced along with the inert gas GI if the material is a carbide. These film deposition steps are effected alternately at different positions. This can restrain formation of amorphous carbon and other impurities rather than a process wherein two targets are disposed at different positions and sputtering is carried out while continuously introducing the reactive gas G2.

One useful means for carrying out sputtering and reactive sputtering alternately in a common vacuum chamber in this way is by controlling the operation of a shutter 18, for example. For further suppressing formation of impurities, it is acceptable to provide an additional shutter on the side of the substrate 1 and control the operation of the shutter on the substrate 1 side in synchronization with the operation of the opposing shutter 18 on the targets 15 and 16 side.

The substrate temperature is about 100° to 400° C., the pressure is about 0.1 to 2.0 Pa, the flow rate of the surrounding gas is about 20 to 100 sccm in total, and the amount of reactive gas when introduced is about 1 to 20% of the entire gases.

Also a power supply 17 may have an RF power of about 0.3 to 3.0 kw. When sputtering is effected for forming thin layers 3a of Ni or the like, anode grounding or other useful means may be taken. When reactive sputtering is effected for forming thin layers 3b of elements to constitute conductive submicron particles 8, application of a negative bias voltage of up to about 500 V to the substrate side or other useful means may be taken, if necessary.

Figure 18:
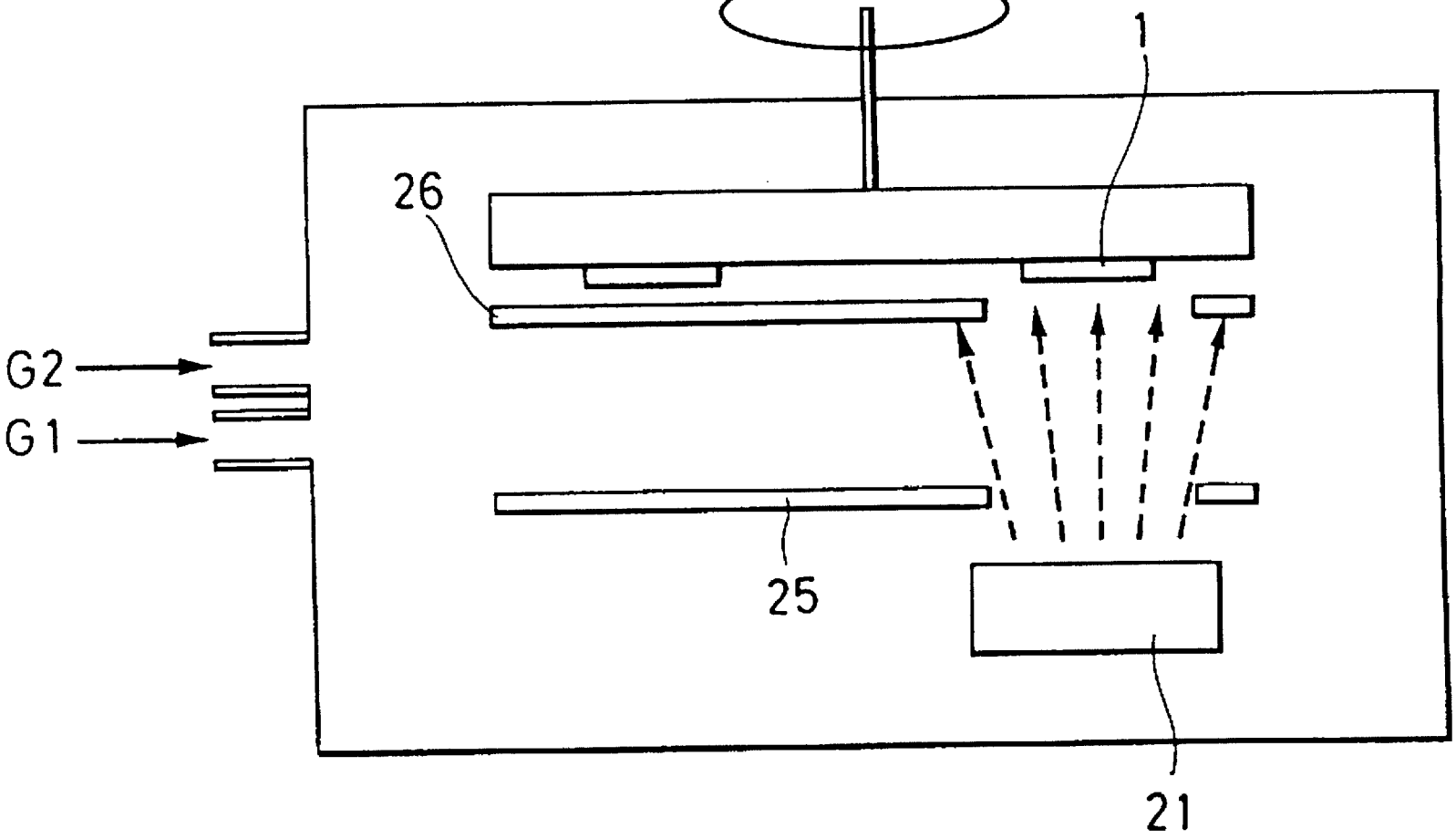
FIG. 18 is a schematic view showing one exemplary dual shutter type sputtering apparatus used in the present invention.

It is also possible to effect sputtering and reactive sputtering alternately using only the material of the cold cathode base 4 as a target. For a combination of TiC-Ti, for example, a turntable having insulating substrates 1 rested thereon is opposed to a target 21 of the cold cathode base material such as Ti as shown in FIG. 18, whereby sputtering and reactive sputtering are, alternately carried out.

Thin layers 3a of Ti or the like are formed by sputtering with only an inert gas G1 such as Ar introduced And thin layers 3b of elements to constitute the conductive submicron particles 8 are formed by reactive sputtering with both an inert gas G1 such as Ar and a reactive gas G2 such as a hydrocarbon introduced. Specific conditions are the same as previously described. For further suppressing formation of amorphous carbon and other impurities, it is preferable to operate shutters 25 and 26 disposed in proximity to the target 21 and the substrate 1, respectively, upon switching of the surrounding gas as shown in FIG. 18.

Preferably the thin layers 3a of an element to constitute the cold cathode base 4 have a thickness of about 1 to 100 nm, more preferably about 10 to 40 nm. Within such a thickness range, there is obtained a cold cathode 10 having conductive submicron particles 8 well dispersed therein. In contrast, if the layers 3a are too thick, the amount of conductive submicron particles 8 dispersed therein would be reduced, leading to the same properties as those of a cold cathode consisting essentially of the cold cathode base 4. If the layers 3a are too thin, dispersion of conductive submicron particles 8 would be exacerbated to restrain microprocessing.

Also preferably the thin layers 3b of components to constitute the conductive submicron particles 8 have a thickness of 0.5 nm to 50 nm (5 Å to 500 Å), more preferably 1 nm to 10 nm (10 Å to 100 Å) Within such a thickness range, there is obtained a cold cathode 10 having conductive submicron particles 8 well dispersed therein. In contrast, if the layers 3b are too thin, nucleation of crystals to form conductive submicron particles of TiC or the like would be insufficient so that impurities such as an amorphous Ti and C mix film are likely to deposit and the volume factor of crystals to form conductive submicron particles of TiC or the like might not be noticeably improved even after heat treatment. It is also difficult to form such ultra-thin layers in a reproducible manner. If the layers 3b are too thick, they would have a continuous film structure which prevents formation of a structure having microcrystalline particles of TiC or the like dispersed and contained in a cold cathode base of Ni or the like. Heat treatment can partially create a structure having microcrystalline particles of TiC or the like dispersed and contained therein, but the continuous film structure is substantially maintained so that etching of the cold cathode-forming conductor layer is difficult.

Further preferably the ratio of thickness of thin layer 3b to thin layer 3a ranges from about 1/99 to ½, more preferably from 1/50 to ⅓. The number of stacking layers may be about 5 to 30 layers for each group. The lowermost layer may be a thin layer 3a of an element to constitute the cold cathode base 4.

Because of the reduced thickness, thin layers 3b of TiC or the like as deposited have an island structure rather than a continuous structure that the surface is entirely covered with TiC or the like ad are in a generally microcrystalline state wherein amorphous and microcrystalline phases are co-present. This can be confirmed by cross-sectional TEM observation.

Figure 13:
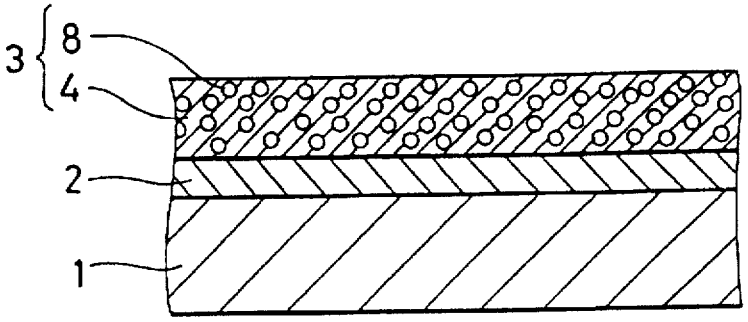
FIG. 13 is a cross-sectional view showing a process for manufacturing the cold cathode electron source element of FIG. 10.

Depending on sputtering conditions, thin layers 3b of components to constitute the conductive submicron particles 8 can be deposited in a satisfactorily crystalline state although it is often preferable to carry out the above-mentioned heat treatment on the cold cathode-forming conductor layer 3 after deposition. The heat treatment improves the crystallinity of the conductive microparticulate material such as TiC as well as the dispersion of conductive submicron particles 8. The method and conditions of heat treatment are the same as previously described. A cross-sectional TEM observation of the cold cathode-forming conductor layer 3 after heat treatment reveals that it has changed into a structure having conductive submicron particles 8 of TiC or the like substantially uniformly dispersed in a cold cathode base 4 of Ni or the like as shown in FIG. 13. It is also confirmed that submicron particles of TiC or the like are crystals within the above-defined particle size range. The improved crystallinity of the conductive microparticulate material such as TiC can also be confirmed by X-ray diffractometry.

Steps subsequent to the formation of the cold cathode-forming conductor layer 3 in this way are approximately the same as in the manufacture of the element of FIG. 1.

Figure 14:
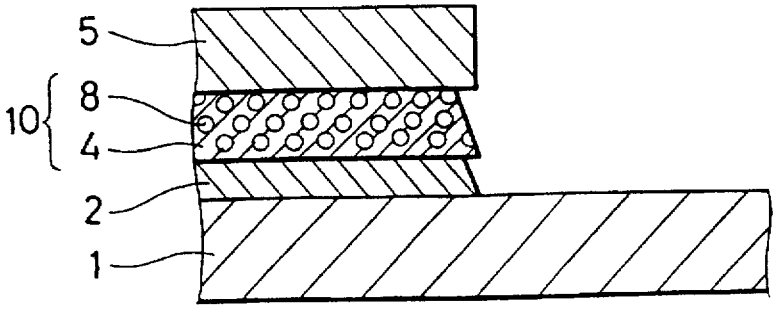
FIG. 14 is a cross-sectional view showing a process for manufacturing the cold cathode electron source element of FIG. 10.

A resist 5 is first formed on the region of the cold cathode-forming conductor layer 3 consisting of the cold cathode base 4 such as Ni and the conductive submicron particles 8 such as TiC that will eventually form a cold cathode. By wet etching with an etching solution such as nitric acid-phosphoric acid solution, the cold cathode-forming conductor layer 3 is then processed into a cold cathode 10. Further the insulating layer 2 is wet etched with an etching solution such as BHF. At this point, the resist is left as such and riot removed. The structure resulting from this step is shown in FIG. 14. It is understood that the cold cathode-forming conductor layer 3 can also be processed into a cold cathode 10 by dry etching such as reactive ion etching (RIE) instead of the above-mentioned wet etching.

Figure 15:
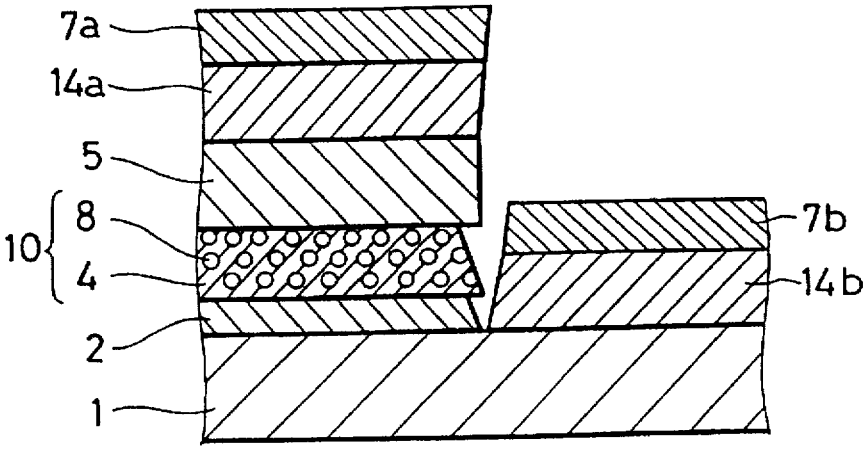
FIG. 15 is a cross-sectional view showing a process for manufacturing the cold cathode electron source element of FIG. 10.

Then as shown in FIG. 15, an insulating film 14a of $SiO_2$ or the like having a predetermined thickness and a film 7a of a selected gate electrode-forming material having a predetermined thickness are deposited in this order over the entire surface by evaporation or the like. At the same time, a gate insulating layer 14b of $SiO_2$ or the like and a gate electrode 7b are formed.

Figure 16:
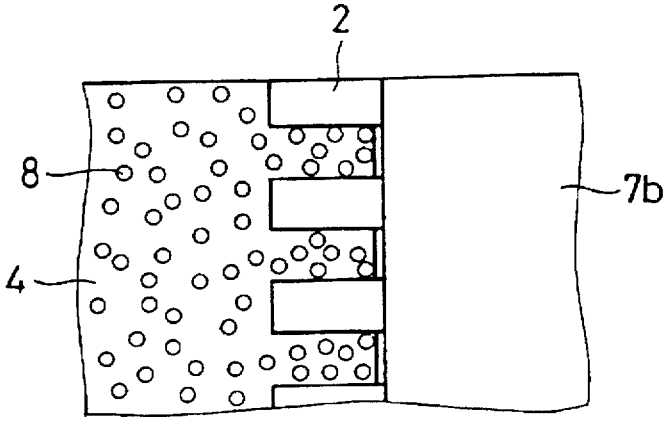
FIG. 16 is a plan view showing one exemplary array of the cold cathode electron source element of FIG. 10.

Since the unnecessary insulating film 14a of $SiO_2$ or the like and the unnecessary film 7a of the same material as the gate electrode such as Cr are present on the resist 5 at this point, a next step is to lift off the unnecessary insulating film 14a of $SiO_2$ or the like and the unnecessary film 7a along with the resist 5, obtaining the cold cathode electron source element shown in FIG. 10. The cold cathode electron source element may have an array as shown in FIG. 16, for example.

Figure 19:
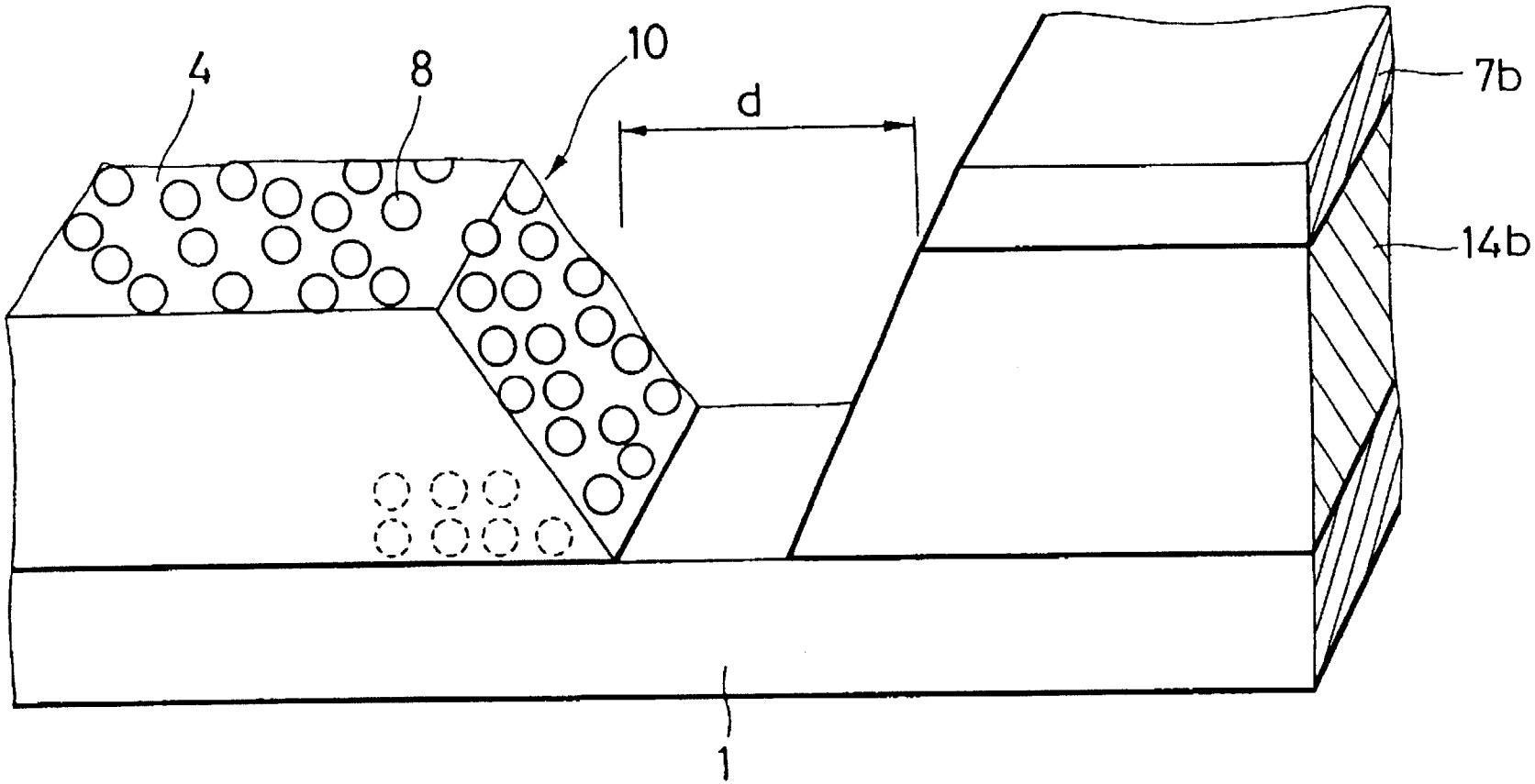
FIG. 19 is a fragmental enlarged perspective view of a cold cathode electron source element according to a further embodiment of the invention.

The cold cathode electron source element of the invention may further take the arrangement shown in FIG. 19. The cold cathode electron source element shown in FIG. 19 has the same structure as that shown in FIG. 10 except that the cold cathode 10 is disposed directly on the insulating substrate 1-without interposing an insulating layer therebetween.

The foregoing cold cathode electron source elements are of the structure known as a lateral emitter. Additionally the present invention may take a vertical emitter structure. The vertical emitter can be a high density element having a larger number of elements per unit area than the lateral emitter and be applied to flat panel displays and similar devices requiring X-Y matrix wiring through a relatively simple process.

Figure 20:
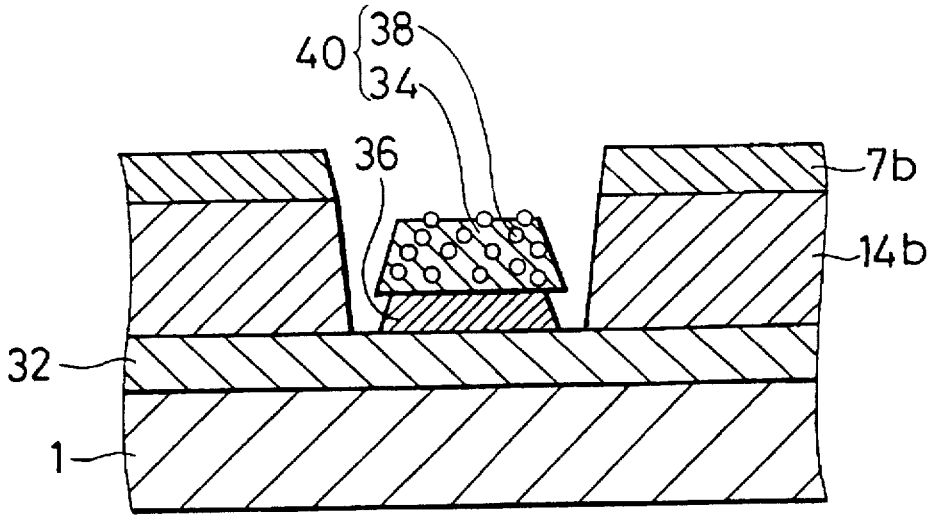
FIG. 20 is a cross-sectional view of a cold cathode 5 electron source element according to a still further embodiment of the invention.
Figure 21:
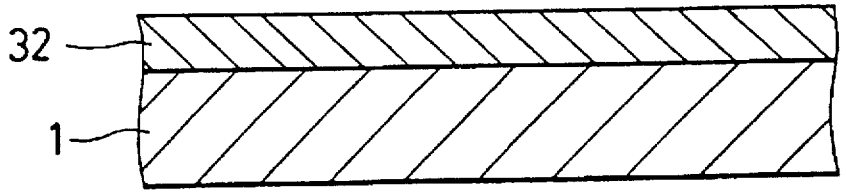
FIG. 21 is a cross-sectional view showing a process for manufacturing the cold cathode electron source element of FIG. 20.
Figure 22:
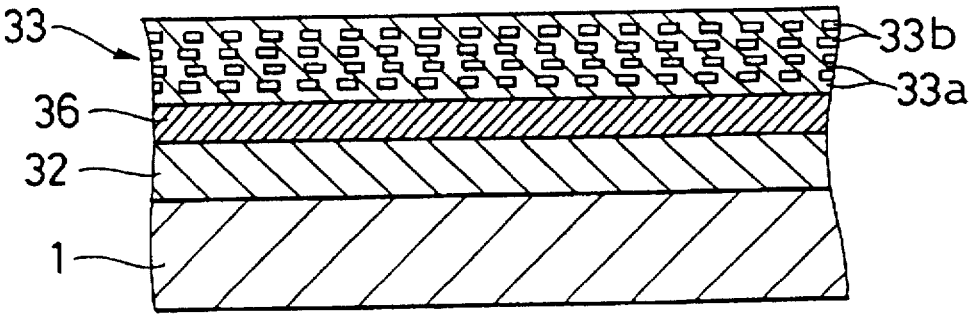
FIG. 22 is a cross-sectional view showing a process for manufacturing the cold cathode electron source element of FIG. 20.
Figure 23:
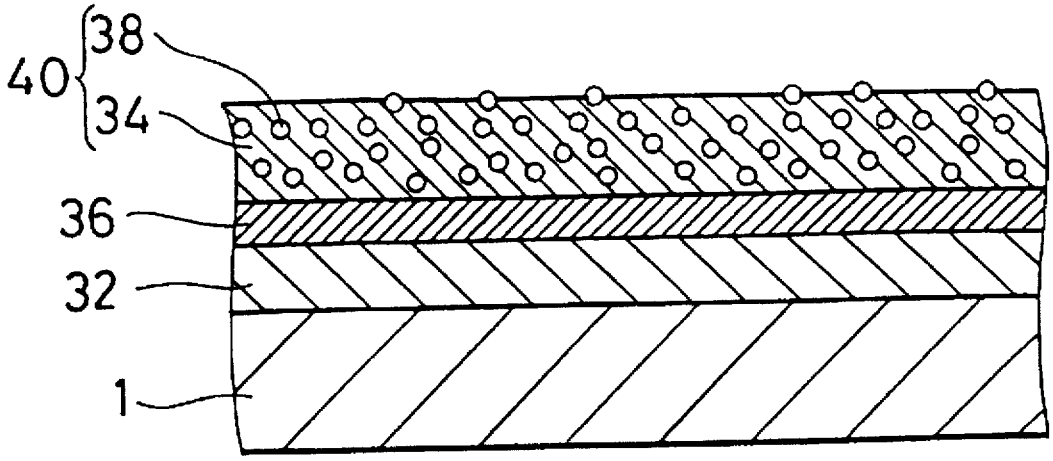
FIG. 23 is a cross-sectional view showing a process for manufacturing the cold cathode electron source element of FIG. 20.

FIG. 20 illustrates a cold cathode electron source element having a cold cathode 40 and a gate electrode 7b surrounding the cathode. In the illustrate embodiment, both the outer peripheral shape of the cold cathode 40 and the inner peripheral shape of the gate electrode 7b are circular. Also in this structure, the present invention has the advantage of eliminating a need to finely process the emitter into a conical shape. This element is prepared in accordance with the steps of FIGS. 21 to 25. First, as shown in FIG. 21, an emitter-forming wiring layer 32 is deposited on a glass substrate 1 and then processed into a predetermined wiring pattern by conventional photo-lithography. Then as shown in FIG. 22, a conductive spacer layer 36 is formed on the surface of the emitter-forming wiring layer 32 and a cold cathode-forming conductor layer 33 is deposited thereon by alternate sputtering. Thereafter, the cold cathode-forming conductor layer 33 is heat treated. Through the heat treatment, the conductive microparticulate material in the cold cathode-forming conductor layer 33 changes its structure from an island structure 33b as shown in FIG. 22 to a microparticulate dispersed structure as shown in FIG. 23, forming conductive submicron particles 38. Concurrently, the cold cathode base 33a in the cold cathode-forming conductor layer 33 changes into a more crystalline cold cathode base 34. There is formed a cold cathode-forming conductor layer 40 having the conductive submicron particles 38 dispersed in the cold cathode base 34.

Figure 24:
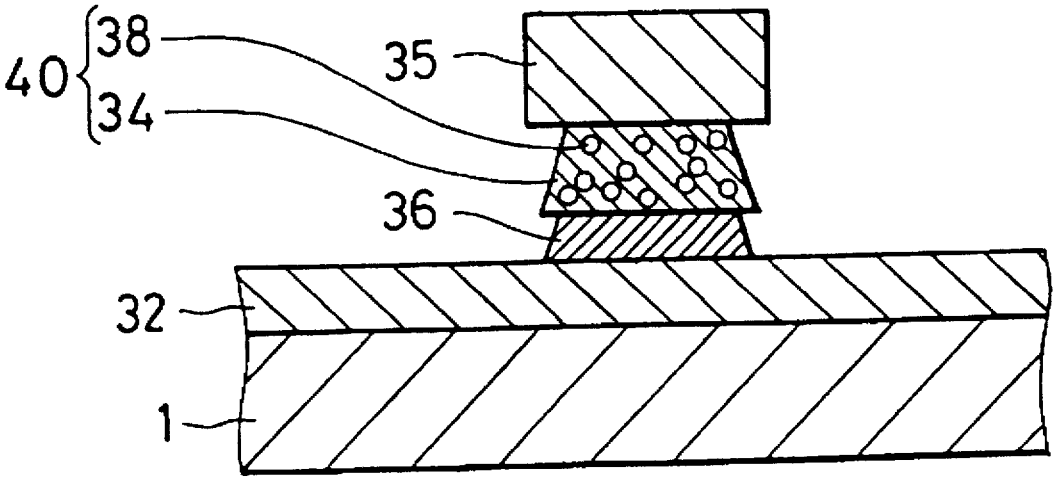
FIG. 24 is a cross-sectional view showing a process for manufacturing the cold cathode electron source element of FIG. 20.
Figure 25:
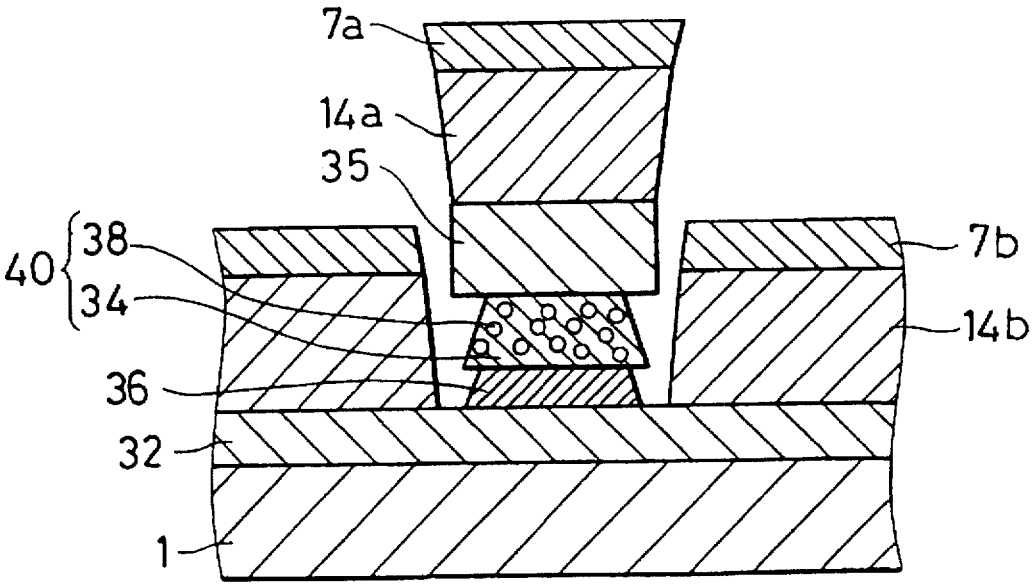
FIG. 25 is a cross-sectional view showing a process for manufacturing the cold cathode electron source element of FIG. 20.
Figure 26:
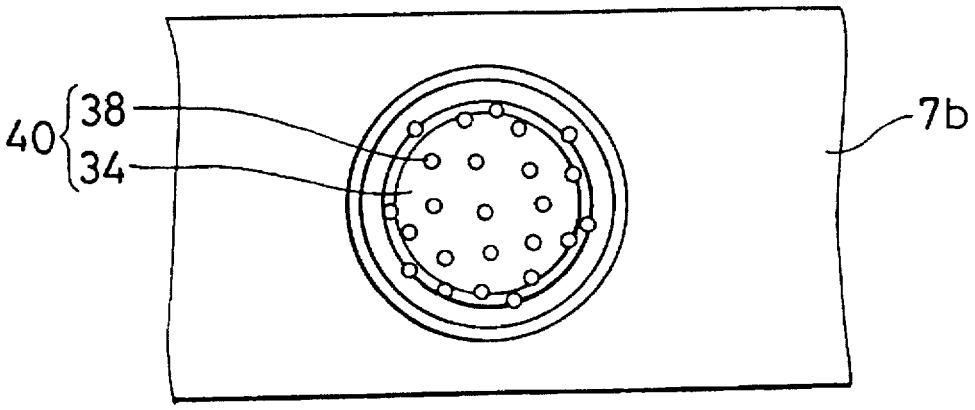
FIG. 26 is a plan view showing one exemplary gate wiring pattern of the cold cathode electron source element of FIG. 20.

Thereafter, a circular resist pattern 35 is formed on the surface of a selected element region of the cold cathode-forming conductor layer 40 by photolithography as shown in FIG. 24, and the cold cathode-forming conductor layer 40 is etched. Then the spacer layer 36 is processed by dry etching, for example, forming a structure as shown in FIG. 24. Furthermore, in order to form a gate insulating layer 14b and a gate electrode 7b, a film of the same material as the gate insulating layer 14b and a film of the same material as the gate electrode 7b are deposited in this order over the entire surface by evaporation or the like as shown in FIG. 25. Since the unnecessary films 14a and 7a are present on the resist 35 at this point, the resist and unnecessary films 14a and 7a are removed by immersion in a resist stripping solution. As a result, a cold cathode electron source element as shown in FIG. 20 is fabricated. Thereafter, the gate electrode layer 7b and gate insulating layer 14b are processed by photo-etching, forming a gate wiring pattern as shown in FIG. 26, for example.

The cold cathode electron source element of the invention is not limited to the foregoing embodiments and includes various other embodiments.

Figure 27:
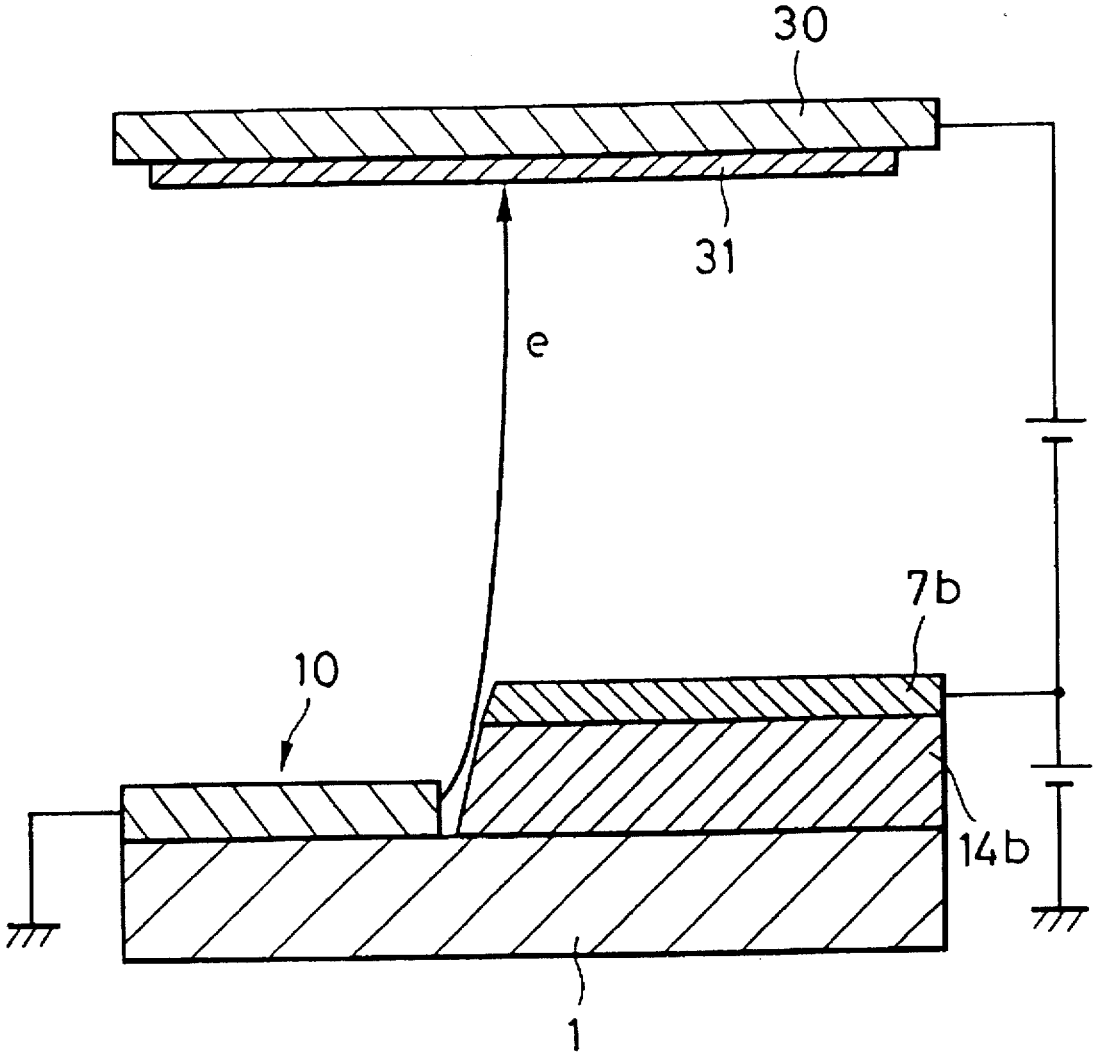
FIG. 27 is a cross sectional view showing one exemplary application of the cold cathode electron source element of the present invention.

FIG. 27 shows an exemplary, application of the cold cathode electron source element of the invention. Shown in FIG. 27 is an arrangement wherein a cold cathode electron source element having disposed on an insulating substrate 1 a cold cathode 10 and a gate electrode 7b with an interposing gate insulating layer 14b is used as an electron source for a flat panel display. By applying a voltage across the cold cathode 10 and the gate electrode 7b as shown in the figure, an electric field is concentrated at the surface of the cold cathode 10 to evoke emission of electrons e. While the amount of electrons e emitted is properly controlled by the action of the gate electrode 7b, electrons e reach an anode 30 having a fluorescent material layer 31 borne on its surface. By the action of electrons, the fluorescent material layer 31 then emits light. And otherwise, the cold cathode electron source element of the invention may be applied as high-frequency amplifiers, switching elements and the like.

EXAMPLE

Examples of the invention are given below by way of illustration.

Example 1

A cold cathode electron source element as shown in FIG. 1 was fabricated according to the steps of FIGS. 2 to 6. First of all, as shown in FIG. 2, an insulating layer 2 of $SiO_2$ was deposited on the surface of an insulating substrate 1 of glass (1.1 mm thick) to a thickness of 1 μm by a sputtering process. Next, as shown in FIG. 3, a thin film having TiC particles as the conductive submicron particles 8 finely dispersed in Ni as the cold cathode base 4 was deposited-thereon to a thickness of 0.3 μm by a reactive ion plating process, forming a cold cathode 10.

The reactive ion plating process used a substrate temperature of 400° C., a Ni-50% Ti alloy as an evaporation source which was heated by electron beams, $C_2H_2$ gas as a carbon source which was introduced at 0.11 Pa, a probe current of 2 A for ionization, and a substrate-hearth bias voltage of 2 kV.

Figure 7:
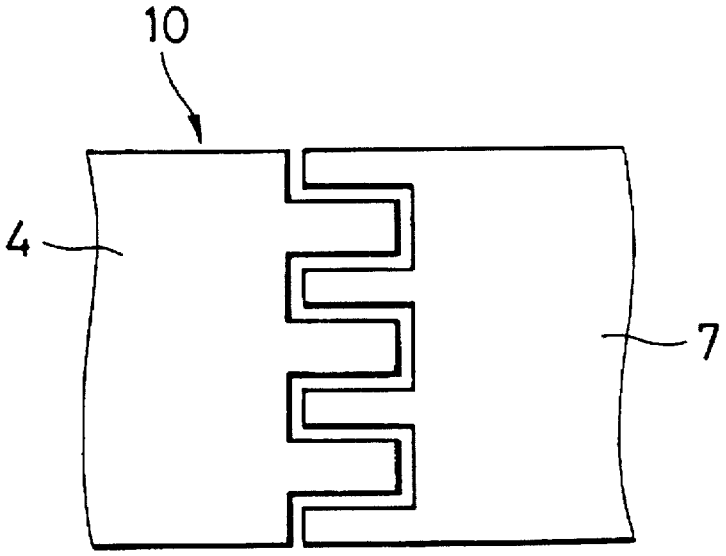
FIG. 7 is a plan view showing one exemplary pattern of the cold cathode electron source element of FIG. 1.

Next, as shown in FIG. 4, after a resist 5 was formed on the cold cathode 10, the cold cathode 10 was configured by patterning according to the pattern of FIG. 7 by a photo-process and wet etching with an etching solution of a nitric acid-phosphoric acid system, and then the insulating layer 2 was wet etched with BHF. At this point, the resist 5 on the cold cathode 10 was left unchanged and not removed. As shown in FIG. 5, a Cr film serving as a Cr film 6 and a gate electrode 7 was formed over the entire surface to a thickness of 0.3 μm by an evaporation process. Thereafter, the resist 5 and Cr film 6 were removed with a stripping solution as shown in FIG. 6.

In this way, the cold cathode electron source element of FIG. 1 was obtained. The distance d between the cold cathode 10 and the gate electrode 7 was about 0.7 μm. In the cold cathode, the TiC particles had a mean particle size of about 5 nm as determined from a TiC (200) plane peak in XRD. The mean particle size of primary particles as determined from a TEM photograph was about 5 nm. The proportion of TiC particles relative to the Ni matrix was about 25% by volume. It is to be noted that TiC has a work function of 3.53 eV and Ni has a work function of 4.50 eV.

In a test for examining the drive voltage applied to the cold cathode electron source element for electron emission, electron emission was found at a gate voltage of about 20 V with an emission current variation of up to 5%. This is a significant improvement in performance over a prior art cold cathode electron source element wherein electron emission was found at a gate voltage of about 80 V with an emission current variation of about 20 to 40%.

It is believed that since chemically very stable TiC having a low work function and insensitive to adsorption gases could be formed as the microparticulate conductive submicron particles 8 and since the conductive submicron particles 8 Which are dispersed and contained in the cold cathode base 4 as a conductive matrix and exposed at or protruded from the surface of the cold cathode base 4 are distributed at a high population, electron emission occurred at a low voltage, the amount of electrons emitted increased, an electron emission behavior was averaged to provide a stable, electron emission behavior.

Moreover, although it is difficult to subject the conductive submicron particles 8 to micro-processing like etching since the particles 8 themselves are chemically stable, the cold cathode electron source element can be readily formed by etching the cold cathode base 4.

The fact that the conductive submicron particles 8 have a small particle size and are exposed or protruded eliminates a need for sharply configuring the finger tips of the cold cathode 10, which technically simplifies a manufacturing process, achieving an improvement in manufacturing yield.

Example 2

After an $SiO_2$ layer was formed on a substrate as in example 1, a thin film (0.3 μm thick) having TiC particles finely dispersed in Ni was formed by a co-sputtering process using a sputtering apparatus as shown in FIG. 8. The co-sputtering process used a nickel target 11 (thickness 3 mm, diameter 8 inches) and titanium chips 12 rested thereon. Four titanium chips, sized 10 mm×10 mm×1 mm were used. The vacuum was 0.5 Pa, the atmosphere was a mixture of ethylene gas (3 sccm) and argon gas (47 sccm), the power supply 13 had an RF power of 1 kw, and the substrate was at a temperature of 200° C. A bias voltage of −200 V was applied to the anode side.

After the cold cathode-forming conductor layer was formed in this way, as in Example 1, the cold cathode was configured by a photo-process and wet etching with a phosphoric acid-nitric acid etching solution, and the $SiO_2$ layer was wet etched with a BHF etching solution. Over the structure, a gate electrode-forming Cr film was evaporated to a thickness of 0.3 μm under the condition of perpendicular incidence. Thereafter, as in Example 1, the resist and the unnecessary Cr film thereon were removed with a stripping solution, obtaining a cold cathode electron source element (of FIG. 1). The distance between the cold cathode 10 and the gate electrode was the same as in Example 1. In the cold cathode, the TiC particles had a mean particle size of about 1 nm as determined from the result of XRD. The mean particle size of primary particles as determined from a TEM photograph was about 1 nm. The proportion of TiC particles relative to the Ni matrix was 5% by volume.

In a test for examining the performance of this cold cathode electron source element as in Example 1, electron emission was found at a gate voltage of about 40 V with an emission current variation of up to 5%, as opposed to a prior art cold cathode electron source element wherein electron emission was found at a gate voltage of about 80 V with an emission current variation of about 20 to 40%.

It is believed that since chemically very stable TiC having a low work function and insensitive to adsorption gases could be formed as the microparticulate conductive submicron particles 8 and since the conductive submicron particles 8 which are dispersed and contained in the cold cathode base 4 as a conductive matrix and exposed at or protruded from the surface of the cold cathode base 4 are distributed at a high population, electron emission occurred at a low voltage, the amount of electrons emitted increased, an electron emission behavior was averaged to provide a stable electron emission behavior. Moreover, although it is difficult to subject the conductive submicron particles 8 to micro-processing like etching since the particles 8 themselves are chemically stable, the cold cathode electron source element can be readily formed by etching the cold cathode base 4. The fact that the conductive submicron particles 8 have a small particle size and are exposed or protruded eliminates a need for sharply configuring the finger tips of the cold cathode 10, which technically simplifies a manufacturing process, achieving an improvement in manufacturing yield.

Also an element was fabricated by the same procedure as above except that TiC chips were used instead of the Ti chips. Further elements were similarly fabricated using methane gas, propane gas and acetylene gas instead of the ethylene gas. All these elements showed favorable properties as above.

Example 3

As in Example 1, an $SiO_2$ layer was formed on a substrate 1 (FIG. 2). Next a cold cathode-forming conductor layer 9 in the form of a Ni—Ti—C amorphous alloy thin film (or an amorphous nickel-base alloy thin film containing TiC) was formed to a thickness of 0.3 μm as shown in FIG. 9 by a reactive co-sputtering process using a sputtering system as shown in FIG. 8. The co-sputtering process used a nickel target 11 (thickness 3 mm, diameter 8 inches) and titanium chips 12 rested thereon. Fifty titanium chips 12 sized 10 mm×10 mm×1 mm were used. The substrate was at room temperature (about 20° C.), the pressure was 1 Pa, the atmosphere was a mixture of Ar gas and $C_2H_2$ gas introduced at a flow rate of 45 sccm and 5 sccm, respectively, and the power supply 13 had an RF power of 1 kW.

Subsequently, the cold cathode-forming conductor layer thin film was heat treated. Using a resistance heating hater, the thin film was maintained at 500° C. in vacuum for 2 hours. Through a subsequent procedure as in Example 1, a cold cathode electron source element as shown in FIG. 1 was obtained.

Figure 28:
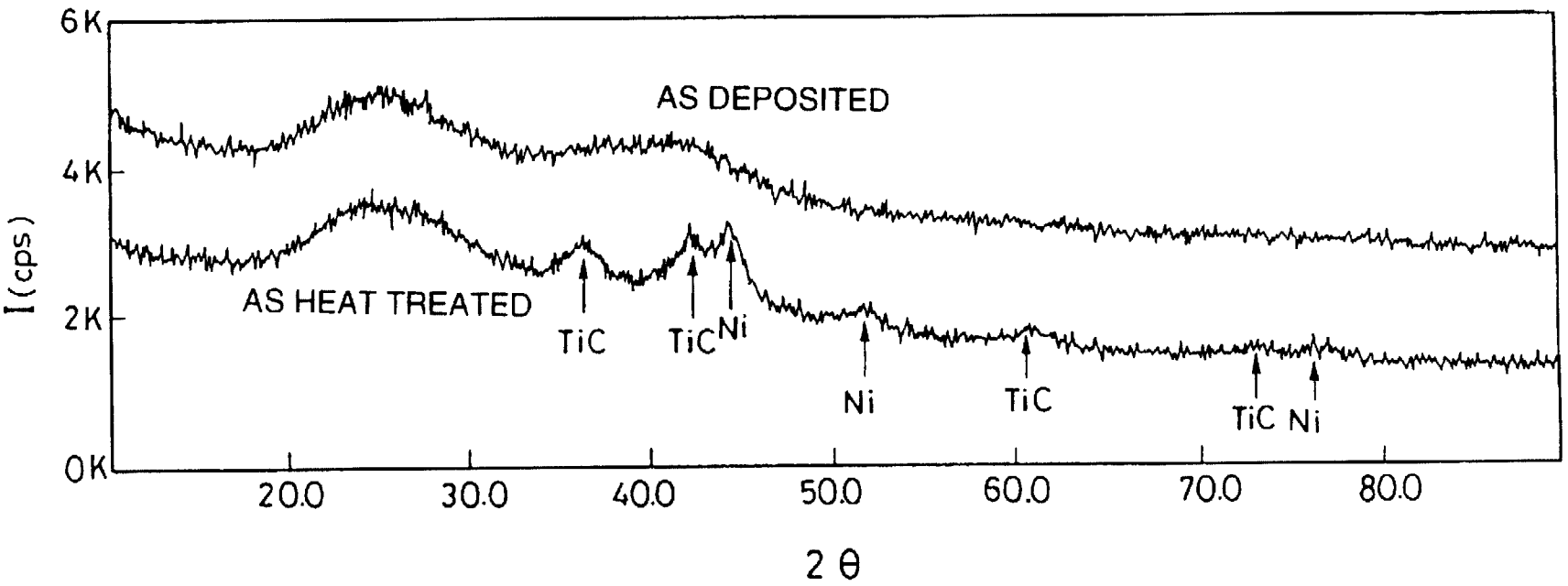
FIG. 28 is a diagram showing the results of X-ray diffractometry on a cold cathode-forming conductor layer both as deposited and as heat treated according to the present invention.

FIG. 28 shows the results of XRD (Cu Kα λ=1.5418, filter: monochrometer) of the cold cathode-forming conductor layer 9 before and after heat treatment during the above procedure. As is evident from the results of FIG. 28, before heat treatment, that is, after deposition of the cold cathode-forming conductor layer, a halo indicative of amorphous phase was found at approximately 40°. A halo at approximately 20° indicates glass of which the substrate was farmed. In contrast, after heat treatment, X-ray diffraction peaks of TiC and Ni were found. It is thus believed that by heat treatment, there was formed a cold cathode having a structure wherein TiC particles as the conductive submicron particles 8 were finely dispersed in Ni as the cold cathode base 4 as shown in FIG. 3.

In the element, the distance d between the cold cathode 10 and the gate electrode was the same as in Example 1. In the cold cathode, the TiC particles had a mean particle size of about 3 nm as determined from the result of XRD. The mean particle size of primary particles as determined from a TEM photograph was about 3 nm. The proportion of TiC particles relative to the Ni matrix was 25% by volume.

In a test for examining the performance of this cold cathode electron source element as in Example 1, electron emission was found at a gate voltage of about 30 V with an emission current variation of up to 5%, as opposed to a prior art cold cathode electron source element wherein electron emission was found at a gate voltage of about 80 V with an emission current variation of about 20 to 40% It is believed that since chemically very stable TiC having a low work function and insensitive to adsorption gases could be formed as the microparticulate conductive submicron particles 8 and since the conductive submicron particles 8 which are dispersed and contained in the cold cathode base 4 as a conductive matrix and exposed at or protruded from the surface of the cold cathode base 4 are distributed at a high population, electron emission occurred at a low voltage, the amount of electrons emitted increased, an electron emission behavior was averaged to provide a stable electron emission behavior Moreover, although it is difficult to subject the conductive submicron particles 8 to micro-processing like etching since the particles 8 themselves are chemically stable, the cold cathode electron source element can be readily formed by etching the cold cathode base 4. The fact that the conductive submicron particles 8 have a small particle size and are exposed or protruded eliminates a need for sharply configuring the finger tips of the cold cathode 10, which technically simplifies a manufacturing process, achieving an improvement in manufacturing yield.

Example 4

A cold cathode electron source element as shown in FIG. 10 was fabricated according to the steps of FIGS. 11 to 15. First of all, as shown in FIG. 11, an insulating layer 2 of $SiO_2$ was deposited on the surface of an insulating substrate 1 of glass (as in Example 1) to a thickness of 200 nm by a sputtering process. Next, using a sputtering apparatus as shown in FIG. 17, a Ni film and a TiC film were alternately deposited in this order to for a cold cathode-forming conductor layer 3 consisting of alternately deposited Ni/TiC layers (FIG. 12). This Ni/TiC alternate deposition sputtering process used a nickel target 15 and a titanium target 16 as shown in FIG. 17 whereby sputtering of a nickel film with argon and reactive sputtering of titanium with argon and $C_2H_2$ were alternately carried out in a common vacuum chamber.

In the case of Ni films, the target 15 of 99.9% or higher purity nickel having a thickness of 3 mm and a diameter of 8 inches was used and the films were deposited to a thickness of 30 nm per layer under the conditions including a substrate temperature of 250° C., a pressure of 0.5 Pa, an Ar gas flow rate of 50 sccm, and a power supply 14's RF power of 1 kW, with the anode side grounded.

Also in the case of TiC films, the target 16 of 99.9% or higher purity titanium having a thickness of 3 mm and a diameter of 8 inches was used and the films were deposited to a thickness of 5 nm per layer under the conditions including a substrate temperature of 300° C., a pressure of 0.5 Pa, an Ar gas flow rate of 47 sccm, an acetylene gas flow rate of 3 sccm, a power supply 17's RF power of 1 kW, and a bias voltage of −200 V applied to the substrate side.

Note that the Ni and TiC films were controlled in thickness by previously depositing a single layer film of about 1 μm thick for each group of films under the same conditions as used in depositing the Ni and TiC films of the alternately deposited Ni/TiC layers, calculating the rates of deposition from the film thickness and the deposition time, calculating from the deposition rates the deposition times taken until a thickness of 30 nm (Ni) or 5 nm (TiC) was reached, and actually depositing the respective films for the calculated deposition times. Under the above-mentioned conditions, Ni and TiC layers, ten layers for each group, were alternately deposited, forming a cold cathode-forming conductor layer 3 in the form of alternately deposited Ni/TiC layers (total thickness about 350 nm) as shown in FIG. 3.

After the cold cathode-forming conductor layer 3 in the form of alternately deposited Ni/TiC layers was formed, the cold cathode-forming conductor layer 3 was heat treated together with the substrate. The heat treatment used a resistance heating heater and maintained the structure in vacuum at a treating temperature of 500° C. for 2 hours.

Next a resist 5 was formed on the region of the cold cathode-forming conductor layer 3 consisting of the cold cathode base 4 of Ni having dispersed therein the conductive submicron particles 8 of TiC that would eventually form a cold cathode. By wet etching with a nitric acid-phosphoric acid etching solution, the cold cathode-forming conductor layer 3 was processed into a cold cathode 10. Further the insulating layer 2 was wet etched with a BHF etching solution. At this point, the resist was left as such and not removed. The structure resulting from, this step is shown in FIG. 14. Then as shown in FIG. 15, an $SiO_2$ film of 500 nm thick and a gate electrode-forming chromium film of 300 nm thick were deposited in this order over the entire surface by an evaporation process, forming a gate insulating layer **14*b* in the form of a $SiO_2$ film a gate electrode 7*b* in the form of a Cr film. Since the unnecessary $SiO_2$ film 14*a* and the unnecessary Cr film 7*a* were present an the resist 5 at this point, a next step was to lift off the resist 5 together with the unnecessary $SiO_2$ film 14*a* and the unnecessary Cr film 7*a*, obtaining the cold cathode electron source element shown in FIG. 10. This cold cathode electron source element had an array shown in FIG. 16**.

TEM observation was made on the cold cathode-forming conductor layer 3 both after deposition (before heat treatment) and after heat treatment during the above procedure. Because of a film thickness as thin as 5 nm, the TiC thin layers as deposited had an island structure rather than a structure wherein the surface is entirely covered with TiC and was in a generally microcrystalline TiC state wherein amorphous and microcrystalline phases were co-present. In contrast, after heat treatment, the cold cathode-forming conductor layer 3 had changed into a structure having conductive submicron particles 8 of TiC substantially uniformly dispersed in a cold cathode base 4 of Ni. Additionally, the TiC submicron particles were single-crystals having a mean particle size of about 5 nm.

The improved crystallinity could also be confirmed by XRD. The particle size of TiC submicron particles as determined from the results of XRD was about 5 nm. In the element, the distance d between the cold cathode 10 and the gate electrode was about 0.4 μm. The proportion of TiC particles relative to the Ni matrix was about 15% by volume.

In a test for examining the performance of this cold cathode electron source element, electron emission was found at a gate voltage of about 5 V with an emission current variation of up to 5%. A emission current of 20 mA per 10,000 chips was available in a stable manner over a long time. This was in contrast to a prior art cold cathode electron source element wherein electron emission was found at a gate voltage of about 80 V with an emission current variation of about 20 to 40% and the maximum available emission current was about 10 mA per 10,000 chips.

It is believed that since chemically very stable TiC having a low work function and insensitive to adsorption gases could be formed as the microparticulate conductive submicron particles 8 and since the conductive submicron particles 8 which are dispersed and contained in the cold cathode base 4 as a conductive matrix and exposed at or protruded from the surface of the cold cathode base 4 are distributed at a high population, electron emission occurred at a low voltage, the amount of electrons emitted increased, an electron emission behavior was averaged to provide a stable electron emission behavior. Moreover, although it is difficult to subject the conductive submicron particles 8 to microprocessing like etching since the particles 8 themselves are chemically stable, the cold cathode electron source element can be readily formed by etching the cold cathode base 4. The fact that the conductive submicron particles 8 have a small particle size and are exposed or protruded eliminates a need for sharply configuring the finger tips of the cold cathode 10, which technically simplifies a manufacturing process, achieving an improvement in manufacturing yield.

Example 5

Sample Nos. 1 and 2 were prepared by modifying the cold cathode-forming conductor layer 3 of the cold cathode electron source element of Example 4 as follows. In sample No. 1, a Ni film (20 nm thick) and a TiC film (10 nm thick), ten layers for each group, were alternately deposited in this order. The films of this example were formed as in Example 4 using the sputtering apparatus shown in FIG. 17. The sputtering conditions were the same as in Example 4.

In sample No. 2, a Ni film (20 nm thick) and a TiC film (5 nm thick), ten layers for each group, were alternately deposited in this order. The films of this example were formed using a dual shutter type apparatus wherein the sputtering apparatus shown in FIG. 17 was modified by providing an additional shutter on the substrate 1 side. The remaining sputtering conditions were the same as in Example 4.

Figure 29:
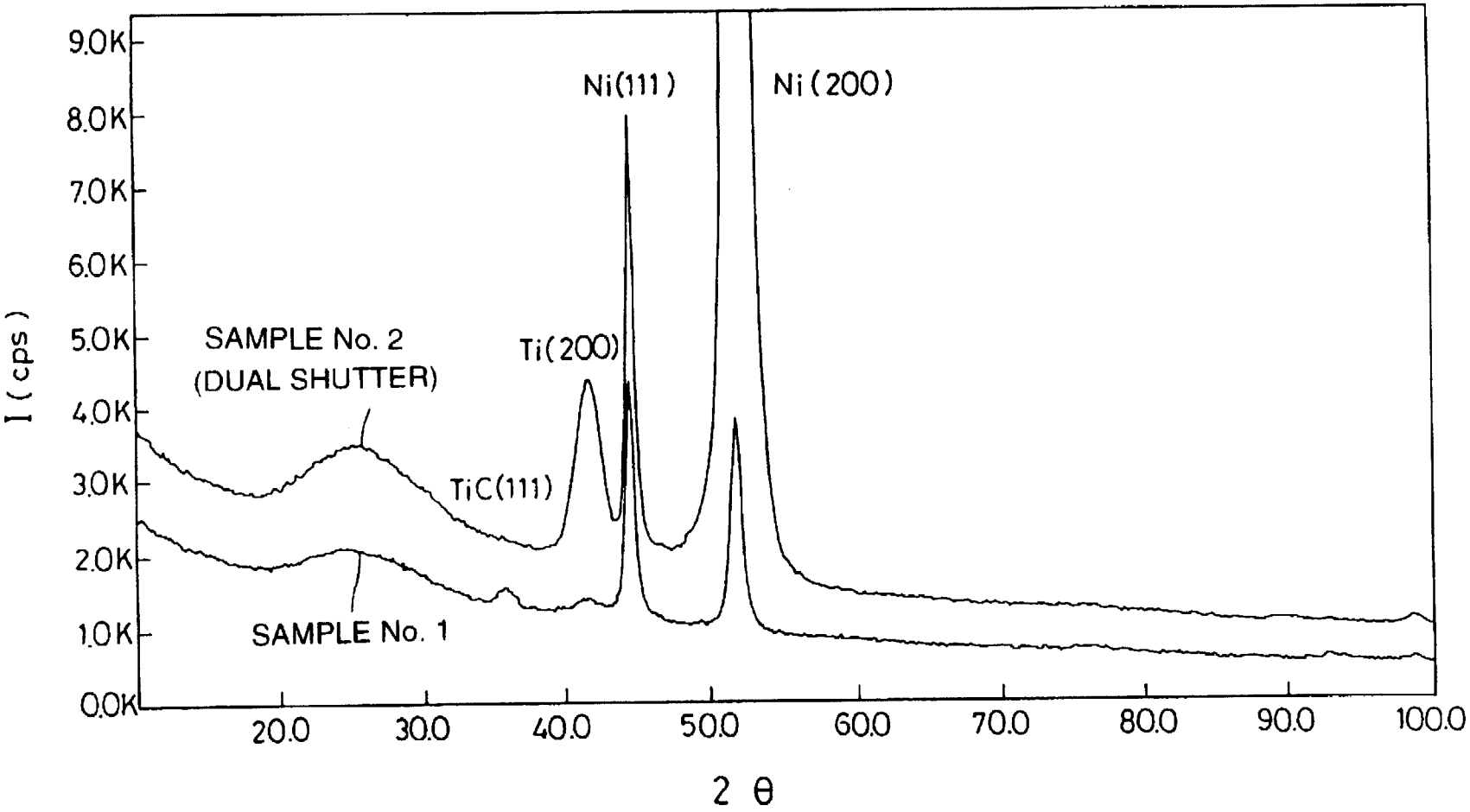
FIG. 29 is a diagram showing in comparison the results of X-ray diffractometry on cold cathode-forming conductor layers according to the present invention.

The results of XRD of sample Nos. 1 and 2 are shown in FIG. 29.

It is evident from the results of FIG. 29 that the use of the dual shutter type sputtering apparatus for deposition is more effective for improving the crystallinity of TiC and Ni. This is probably because deposition of amorphous carbon on the substrate is restrained by positioning an additional shutter on the substrate 1 side.

Example 6

A cold cathode electron source element as shown in FIG. 19 was prepared like the cold cathode electron source element of Example 4 except that no insulating layer of $SiO_2$ was interposed between the cold cathode 10 and the substrate 1. The preparation procedure of this element was in accord with Example 4. Using the sputtering apparatus shown in FIG. 17, the cold cathode-forming conductor layer 3 was formed by first forming a Ni film directly on a glass substrate (trade name Corning #7059 from-Corning Glass Works, 0.7 mm thick) and then alternately depositing TiC and Ni films. The number of stacking layers was 11 layers of Ni film and 10 layers of TiC film while the Ni and TiC films had a thickness of 20 nm and 5 nm, respectively. With respect to sputtering, a dual shutter type apparatus wherein the sputtering apparatus shown in FIG. 17 was modified by providing an additional shutter on the substrate 1 side was used. TiC films were deposited under conditions including a substrate temperature of 300° C., a pressure of 0.5 Pa, an Ar gas flow rate of 46 sccm, an acetylene gas flow rate of 4 sccm, and a power supply 17's RF power of 1 kW, with the anode side grounded. Ni films were deposited under the same conditions as above except that no acetylene gas was introduced.

After the cold cathode-forming conductor layer 3 (total thickness 270 nm) was formed in this way, the cold cathode-forming conductor layer 3 was heat treated together with the substrate. The heat treatment used a resistance heating heater, heated the structure in vacuum at 500° C., and maintained at the temperature for 1 hour.

Thereafter, following the procedure of example 4, a cold cathode electron source element was obtained. Note that the material of the gate electrode used herein was Mo.

Figure 30:
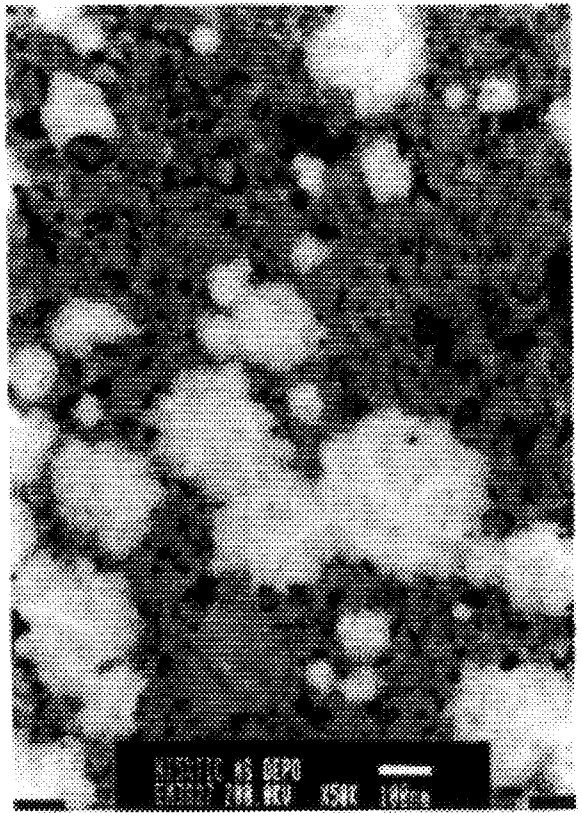
FIG. 30 is a TEM photograph of a cold cathode-forming conductor layer as deposited according to the present invention.
Figure 31:
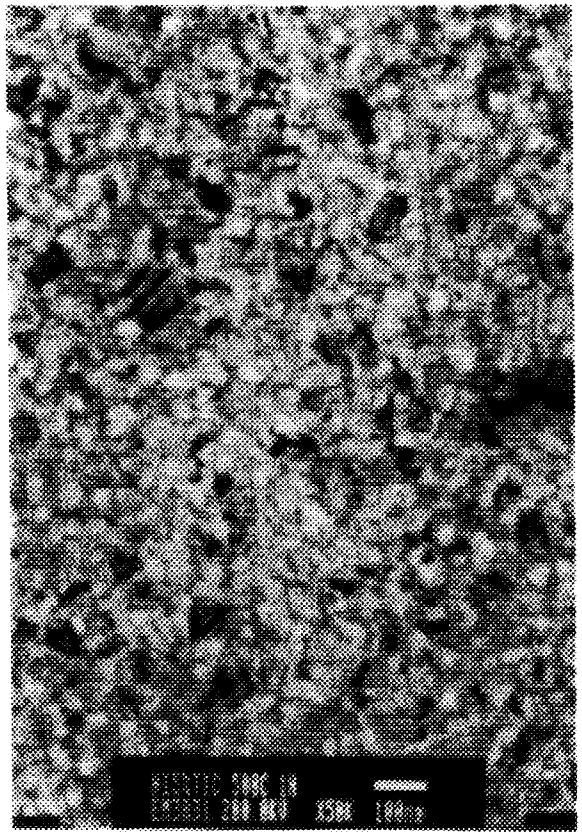
FIG. 31 is a TEM photograph of a cold cathode-forming conductor layer as heat treated according to the present invention.

FIGS. 30 and 31 are TEM photographs of the cold cathode-forming conductor layer after deposition (before heat treatment) and after heat treatment, respectively. These TEM photographs were taken from a sample for TEM observation prepared by forming an alternately deposited Ni(40 nm)/TiC(5 nm)/Ni(40 nm) film (total thickness about 85 nm) under the same conditions as the cold cathode-forming conductor layer 3.

As seen from these photographs, TiC deposited on polycrystalline Ni in an island fashion appeared white in the photograph prior to heat treatment. This TiC is in a generally microcrystalline TiC state in which amorphous and microcrystalline phases are co-present. It is presumed that after heat treatment, more or less Ni crystal grains had grown to spread their grain boundary in which TiC submicron particles were present. As a result, the crystallinity and dispersion of TiC were outstandingly improved and the cold cathode-forming conductor layer 3 after heat treatment changed into a structure as shown in FIG. 13.

Figure 32:
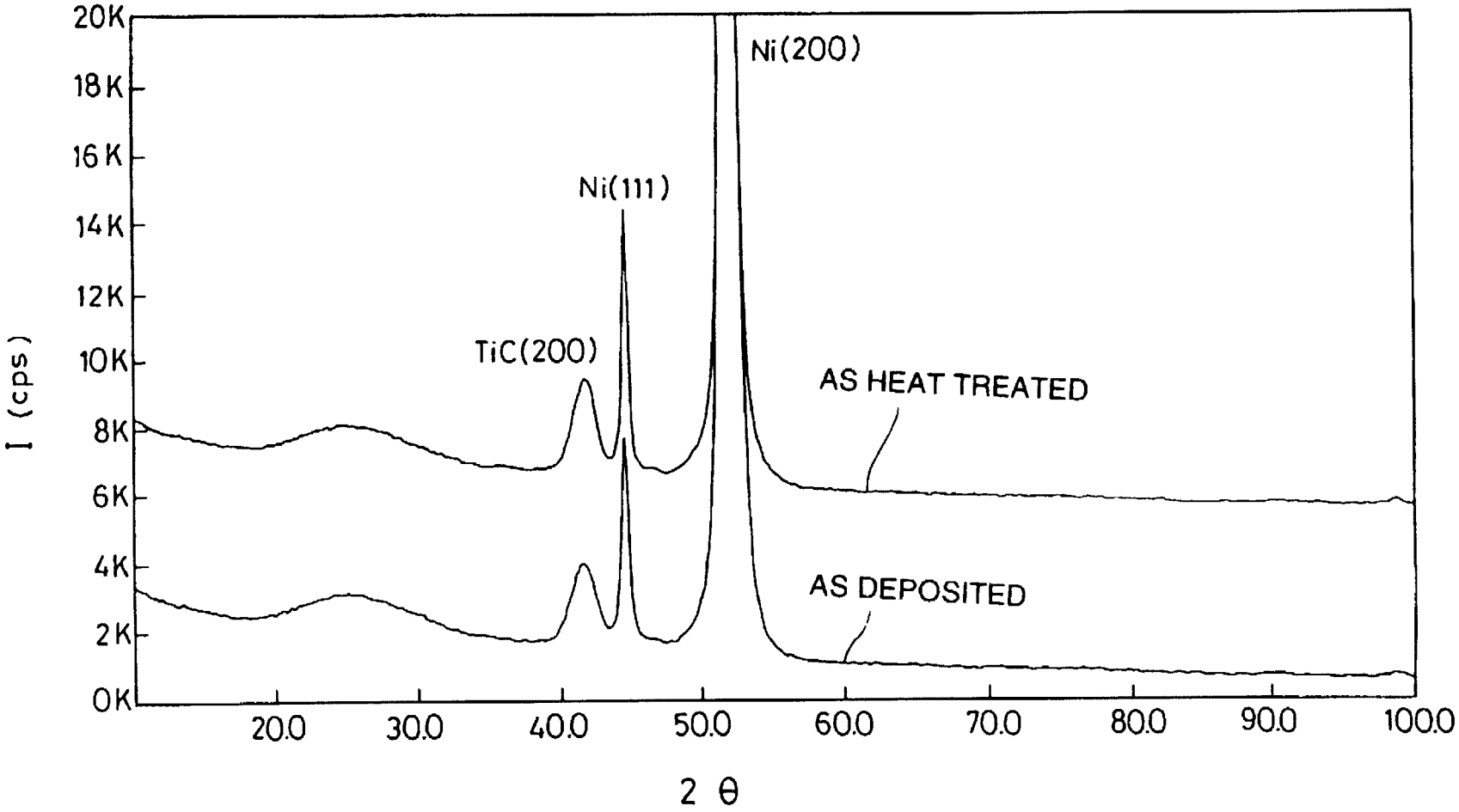
FIG. 32 is a diagram showing the results of X-ray diffractometry on a cold cathode-forming conductor layer both as deposited and as heat treated according to the present invention.

Further, FIG. 32 shows the results of XRD on the cold cathode-forming conductor layer 3 before and after heat treatment. It is evident therefrom that heat treatment increases the peak intensity of Ni and TiC and improves crystallinity.

In the element, the distance a between the cold cathode 10 and the gate electrode was about 1.0 μm. The mean particle size of TiC particles in the cold cathode was about 5 nm as determined from the results of XRD. The mean particle size of primary particles as determined from a TEM photograph was about 5 nm. The proportion of TiC particles relative to the Ni matrix was about 20% by volume.

Figure 33:
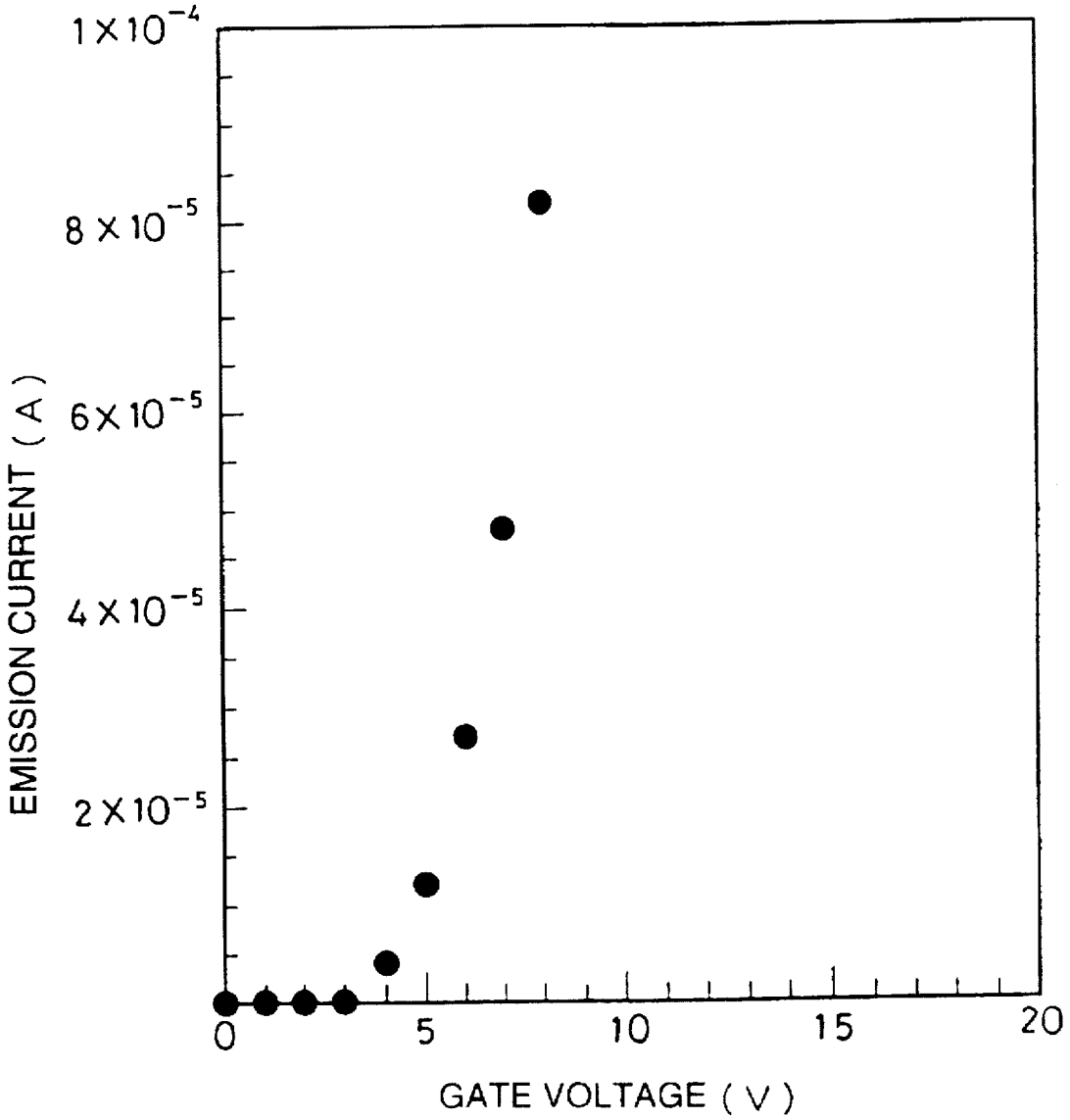
FIG. 33 is a graph showing the emission current versus gate voltage of a cold cathode electron source element according to the present invention.
Figure 34:
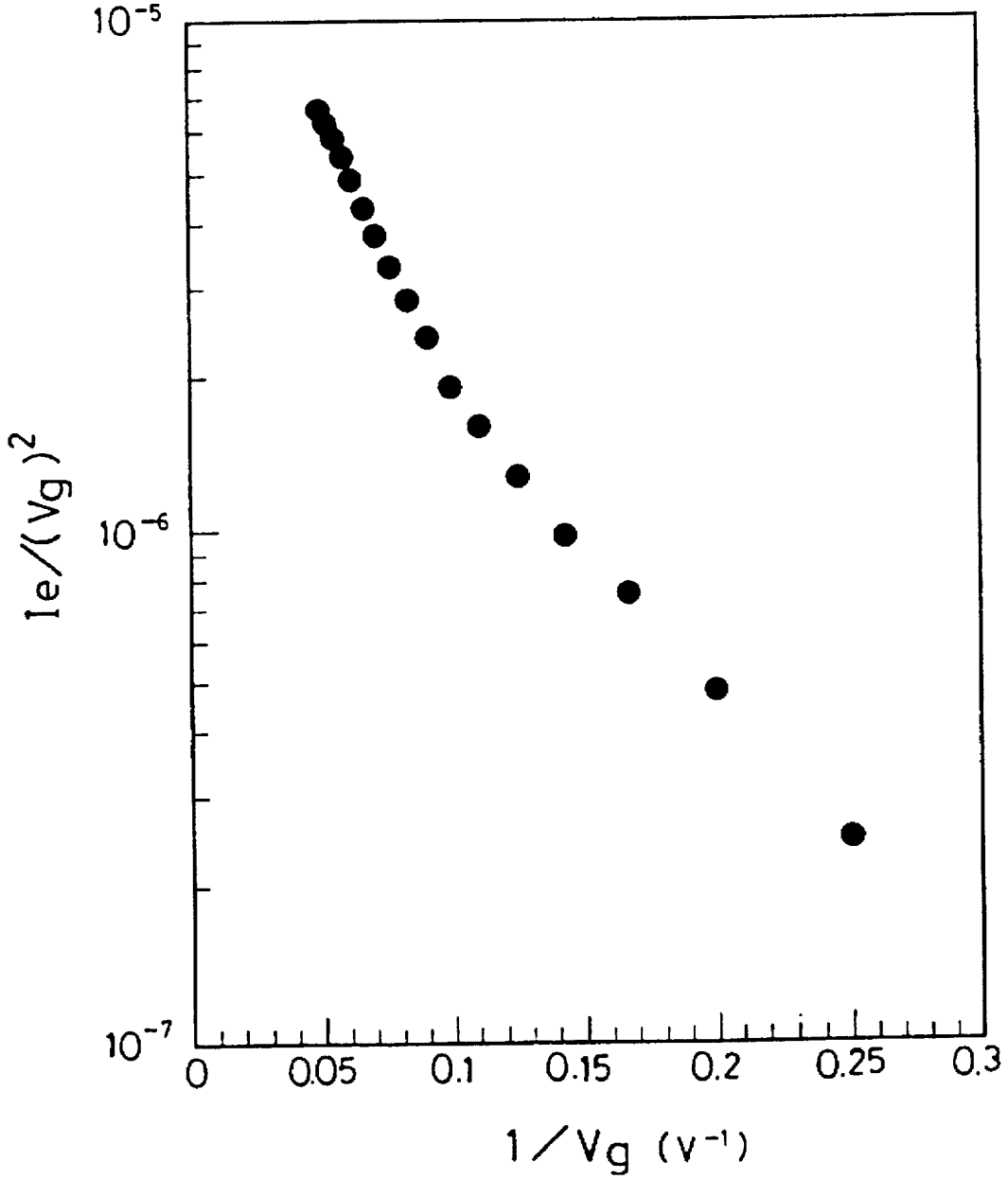
FIG. 34 is a graph showing an F-N plot of a cold cathode electron source element according to the present invention.
Figure 35:
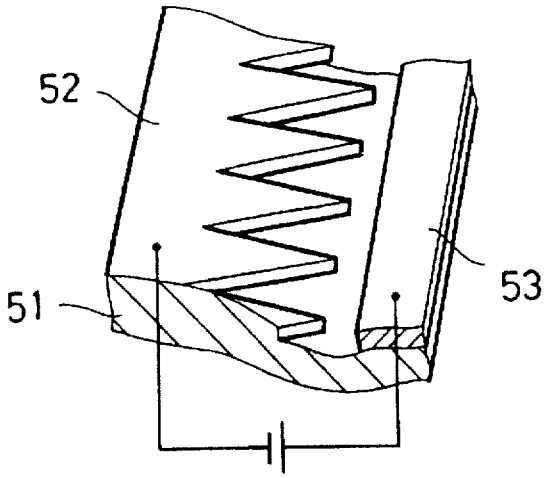
FIG. 35 PRIOR ART
FIG. 35 is a partial perspective view of one example of the prior art electron source.
Figure 36:
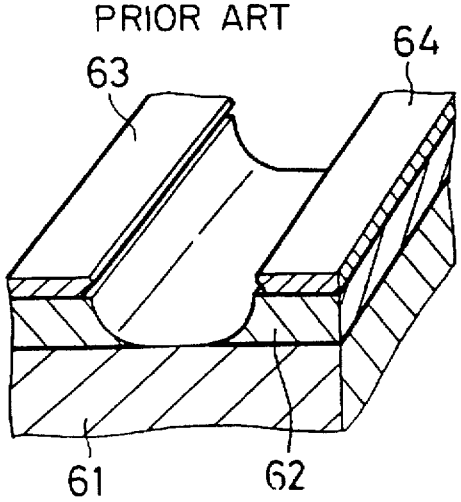
FIG. 36 PRIOR ART
FIG. 36 is a partial perspective view of another example of the prior art electron source.
Figure 37:
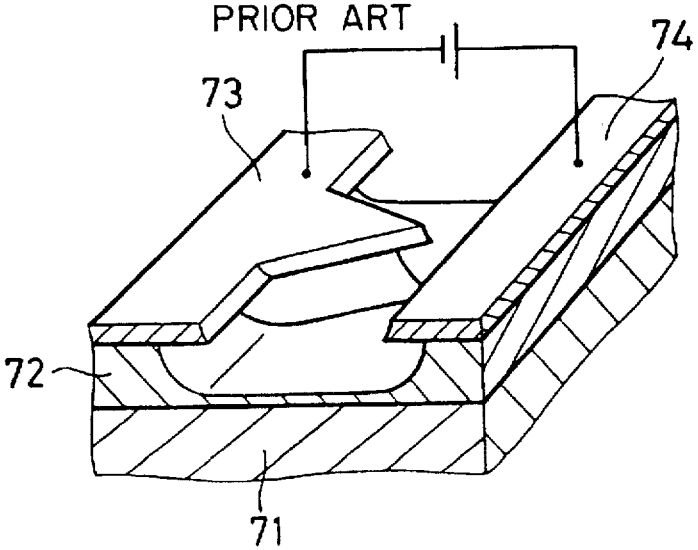
FIG. 37 PRIOR ART
FIG. 37 is a partial perspective view of a further example of the prior art electron source.
Figure 38:
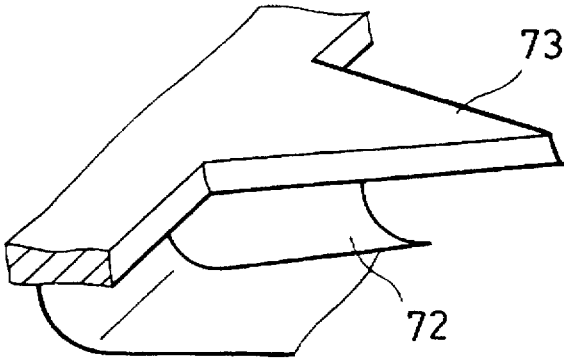
FIG. 38 PRIOR ART
FIG. 38 is a partial perspective view of a still further example of the prior art electron source.
Figure 39:
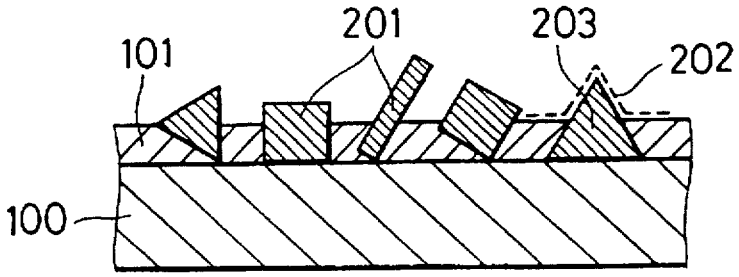
FIG. 39 PRIOR ART
FIG. 39 is a partial cross-sectional view of a yet further example of the prior art electron source.
Figure 40:
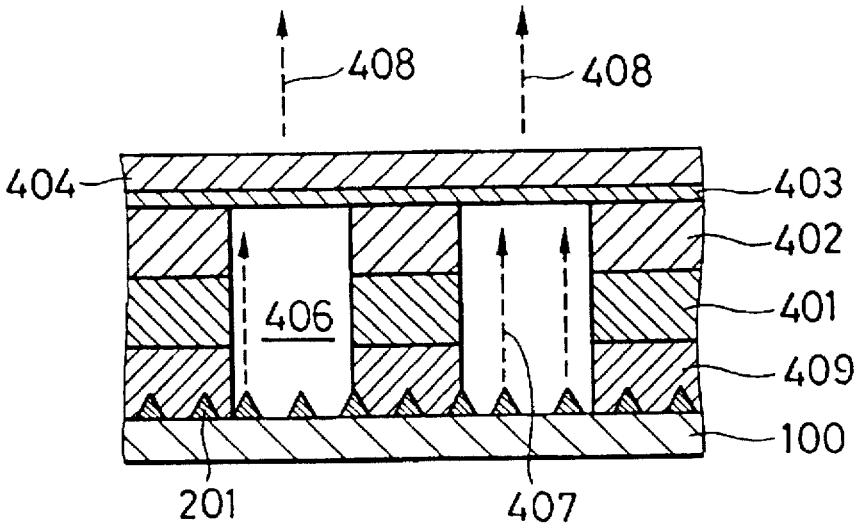
FIG. 40 PRIOR ART
FIG. 40 is a cross-sectional view of a still further example of the prior art electron source.

This cold cathode electron source element was examined for performance. The results are shown in FIGS. 33 and 34. FIG. 33 is a graph showing an emission current (Ie) relative to a gate voltage (Vg), the emission current being per 100,000 chips. FIG. 34 is a Fowler-Nordheim (F-N) plot.

It is seen from these results that the cold cathode electron source element of the invention can be driven with a low voltage since electron emission was found at a gate voltage of about 4 V.

Example 7

A cold cathode electron source element as shown in FIG. 19 was prepared like the cold cathode electron source element of example 6 except that the cold cathode-forming conductor layer 3 for forming the cold cathode 10 was a stack of alternately deposited Ti and TiC films. The cold cathode-forming conductor layer 3 was formed using a sputtering apparatus equipped with a titanium target 21 (same as in Example 4) as shown in FIG. 18. More specifically, a Ti film (20 nm thick) was formed directly on the substrate 1 and a TiC film (5 nm thick) was formed thereon. The number of stacking layers was the same as in example 6. Depositing conditions for Ti films were the same as the Ni films in Example 6 and deposition of TiC films was done as in Example 6.

After the cold cathode-forming conductor layer 3 (total thickness 270 nm) was formed in this way, the cold cathode-forming conductor layer 3 was heat treated together with the substrate. The heat treatment was done under the same conditions as in Example 6. Thereafter, following the procedure of Example 6, a cold cathode electron source-element was obtained. It is to be noted that when the cold cathode-forming conductor layer 3 was processed into the cold cathode 10, reactive ion etching (RIE) was used instead of wet etching. The RIE conditions used herein included a pressure of 15 Pa, a $CF_4$ flow rate of 40 sccm, an $O_2$ flow rate of 10 sccm, an RF power of 500 W, and a substrate temperature of 30° C.

The cold cathode-forming conductor layer was examined by TEM observation and XRD analysis both after deposition (before heat treatment) and after heat treatment during the above procedure. The results show the same tendency as in Example 6, indicating that heat treatment improved the dispersion and crystallinity of TiC. It is thus believed that the cold cathode-forming conductor layer 3 as heat treated had a structure as shown in FIG. 13.

In the element, the distance d between the cold cathode 10 and the gate electrode was about 0.7 μm. The mean particle size of TiC particles in the cold cathode was about 5 nm as determined from the results of XRD. The mean particle size of primary particles as determined from a TEM photograph was about 5 nm. The proportion of TiC particles relative to the Ti matrix was about 20% by volume. Note that titanium has a work function of 3.95 eV.

This cold cathode electron source element was examined for performance as in Example 6 to find acceptable results equivalent to Example 6.

Example 8

A cold cathode electron source element as shown in FIG. 19 was prepared like the cold cathode electron source element of Example 6 except that the cold cathode-forming conductor layer 3 for forming the cold cathode 10 was a stack of alternately deposited Mo and TiC films. The cold cathode-forming conductor layer 3 was formed using the same sputtering apparatus as in Example 6 except that a molybdenum target (Mo purity 99.9% or higher, the same dimensions) was mounted instead of the nickel target. More specifically, a Mo film (20 nm thick) was formed directly on the substrate 1 and a TiC film (5 nm thick) was formed thereon. The number of stacking layers was the same as in Example 6. Depositing conditions for Mo films were the same as the Ni films in Example 6 and deposition of TiC films was done as in Example 6.

After the cold cathode-forming conductor layer 3 (total thickness 270 nm) was formed in this way, the cold cathode-forming conductor layer 3 was heat treated together with the substrate. The heat treatment was done under the same conditions as in Example 6. Thereafter, following the procedure of Example 7, a cold cathode electron source element was obtained.

The cold cathode-forming conductor layer was examined by TEM observation and XRD analysis both after deposition (before heat treatment) and after heat treatment during the above procedure. The results show the same tendency as in Example 6, indicating that heat treatment improved the dispersion and crystallinity of TiC. It is thus believed that the cold cathode-forming conductor layer 3 as heat treated had a structure as shown in FIG. 13.

In the element, the distance d between the cold cathode 10 and the gate electrode was about 0.7 μm. The mean particle size of TiC particles in the cold cathode was about 5 nm as determined from the results of XRD. The mean particle size of primary particles as determined from a TEM photograph was about 5 nm. The proportion of TiC particles relative to the Ti matrix was about 20% by volume. Note that molybdenum has a work function of 4.3 eV.

This cold cathode electron source element was examined for performance as in Example 6 to find acceptable results equivalent to Example 6.

Example 9

A cold cathode electron source element as shown in FIG. 20 was fabricated in accordance with the steps of FIGS. 21 to 25. First, as shown in FIG. 21, an aluminum film as the emitter wiring layer 32 was formed on a glass substrate of 1.1 mm thick to a thickness of 0.3 μm by a sputtering process and then processed into a predetermined wiring pattern by conventional photolithography.

Next, as shown in FIG. 22, Mo (200 nm thick) and Ni/TaC were deposited by sputtering on the surface of the emitter wiring layer 32 to form a spacer layer 36 and a cold cathode-forming conductor layer 33, respectively. In depositing the spacer layer 36 and cold cathode-forming conductor layer 33, a dual shutter type sputtering apparatus as shown in FIG. 18 wherein targets of Mo, Ni, and Ta were mounted was used whereby the layers were continuously formed in a common vacuum chamber. The No, Ni, and Ta targets used had a purity of 99.9% or higher, a thickness of 3 mm and a diameter of 8 inches.

Mo films were deposited under conditions including a substrate temperature of 300° C., an Ar gas flow rate of 50 sccm, a pressure of 0.5 Pa, and a power supply 17's RF power of 1 kW, with the anode side grounded. Ni/TaC films were deposited by the same alternate deposition process as in Example 6 wherein a Ni film (20 nm thick) and a TaC film (5 nm thick) were alternately deposited in this order to form 11 layers and 10 layers, respectively. The depositing conditions were the same as in Example 6 except that the Ti target was replaced by a Ta target.

After the cold cathode-forming conductor layer 3 (total thickness 270 nm) was formed in this way, the cold cathode-forming conductor layer was heat treated together with the substrate. The heat treatment used a resistance heating heater, heated the structure in vacuum at 500° C., and maintained at the temperature for 1 hour. Through this heat treatment, TaC in the cold cathode-forming conductor layer changed from an island structure **33*b* as shown in FIG. 22 to a microparticulate dispersed structure as shown in FIG. 23**.

The cold cathode-forming conductor layer (33 and 40) was examined by TEM observation and XRD analysis both after deposition (before heat treatment) and after heat treatment during the above procedure. The results showed the same tendency as the alternately deposited Ni/TiC layer. It was found that heat treatment caused the TaC crystal particles to assume a particle size of 5 nm approximately equal to the layer thickness, improving the dispersion and crystallinity of TaC.

Thereafter, as shown in FIG. 24, a circular resist pattern 35 having a diameter of 1 μm was formed on the surface of a selected element region of the cold cathode-forming conductor layer 40 by photolithography. The heat treated cold cathode-forming conductor layer 40 was then etched with a nitric acid-phosphoric acid etchant. Next, the spacer layer 36 was processed by dry etching with a gas mixture of $CF_4$+$O_2$, forming a structure as shown in FIG. 24.

Thereafter, as shown in FIG. 25, to form a gate insulating layer **14*b* (600 nm thick) and a gate electrode 7*b* (200 nm thick), $SiO_2$ and Cr were deposited over the entire surface in this order by an evaporation process. Since the unnecessary $SiO_2$ film 14*a* and Cr film 7*a* are present-on the resist 5, the structure was immersed in a resist stripping solution to remove the resist and the unnecessary $SiO_2$ film 14*a* and Cr film 7*a*, obtaining the cold cathode electron source element shown in FIG. 20. Thereafter, the gate electrode 7*b* and gate insulating layer 14*b* were photo-etched, forming a gate wiring pattern as shown in FIG. 26. It is noted that the proportion of TaC particles relative to the Ni matrix in the cold cathode 40** was about 20% by volume. TaC has a work function of 3.93 eV.

This cold cathode electron source element was examined for performance as in Example 6 to find acceptable results equivalent to Example 6.

Additionally, cold cathodes were formed as in Examples 6 to 9 using combinations of various materials such as No-TiN and Cr-$LaB_6$ and similarly examined for performance to find equivalent results.

Advantages

According to the present invention, there is provided a cold cathode electron source element which allows electrons to be extracted with a low voltage to provide high emission current so that the element can be driven by an integrated circuit (IC), thin film transistor (TFT) or the like, promising performance improvement and power consumption saying of devices and which allows the cold cathode base to be processed by a conventional photo-process and etching so that the element can be simply configured to any desired shape and increased in surface area.

In the preferred embodiment wherein particles of conductive material are distributed in an exposed or protruding state with respect to the surface of the cold cathode, there is provided a cold cathode electron source element which enables electron extraction with a low voltage due to concentration of an electric field and offers a high emission current.

In the further preferred embodiment wherein particles of conductive material have a smaller mean particle size, there is provided a cold cathode electron source element which offers a high emission current and exhibits a stable emission current behavior.

When a method of forming the cold cathode by heat treatment is used, processability of the cold cathode-forming conductor layer by etching is improved, leading to improvements in productivity.

The embodiment wherein heat treatment is used so that the conductive material is further improved in crystallinity provides a cold cathode electron source element which enables electron extraction with a low voltage and exhibits a stable emission current behavior.

In the embodiment wherein the cold cathode is formed by an alternate deposition process so that the particle size of conductive material particles may be controlled in terms of the thickness of a thin layer composed of the components to constitute the conductive material particles and thus the electron extracting voltage can be controlled low, there is provided a cold cathode electron source element having an electron extracting voltage which is lower by one order than in the conventional elements and offering a stable high emission current.

Furthermore, where the thickness of a thin layer composed of the components to constitute the conductive material particles is set within a specific range and the thin layer composed of the components to constitute the conductive material particles has an island structure rather than a continuous film structure, it is possible to form a structure wherein conductive material particles are substantially dispersed in the cold cathode base. As a consequence, the cold cathode base can be readily etched with an etchant for the cold cathode base material and a structure wherein particles of conductive material are exposed at or protrude from the etched section of the cold cathode base can be consistently formed in a reproducible manner. Then a cold cathode electron source element which can be driven with a low voltage and produce high emission current in a stable manner can be manufactured in high yields.

Moreover, where the cold cathode-forming conductor layer is further heat treated, the cold cathode base and conductive material particles are increased in crystal grain size, and the component to constitute the conductive material particles which is incorporated into the cold cathode base as an impurity and the component to constitute the cold cathode base which is incorporated into the conductive material particles as an impurity precipitate at grain boundaries, resulting in a substantial increase of the dispersity of the conductive material particles in the cold cathode base. A result, when the cold cathode base is formed by etching, the etching rate of chemical etching can be increased. Furthermore, since the mean particle size of conductive material particles is uniformed approximately to the thickness of a thin layer of the components to constitute the conductive material particles, a cold cathode electron source element capable of uniform electron emission over an increased area can be formed.

We claim:

1. A cold cathode electron source element having a cold cathode, said cold cathode comprising a cold cathode base and particles of a conductive material dispersed and contained in said base having a lower work function than said base, a particle size which is less than the thickness of said cold cathode base and a mean particle size between 0.5 and 50 nm, said particles being dispersed in a substantially discrete relationship, exposed at a surface of said cold cathode and protruding from the surface of said cold cathode, wherein electrons are emitted from said particles at the surface of said cold cathode.

2. The cold cathode electron source element of claim 1 wherein said particles have a mean particle size of 0.5 nm to 50 nm as determined from X-ray diffractometry.

3. The cold cathode electron source element of claim 1 wherein said particles have a mean particle size of 0.5 nm to 50 nm as measured by observation under a transmission electron microscope.

4. The cold cathode electron source element of claim 1 wherein said particles are contained in an amount of 1 to 50% by volume based on said cold cathode base.

5. The cold cathode electrode source element of claim 1 wherein the material of the cold cathode base is a conductor.

6. A cold cathode electron source element having a cold cathode, said cold cathode comprising a cold cathode base, which is formed by depositing a component for said cold cathode base by a vapor phase technique, and particles of a conductive material, which are formed by depositing a component for said conductive material by a vapor phase technique, dispersed and contained in said base and having a lower work function than said base, a particle size which is less than the thickness of said cold cathode base and a mean particle size between 0.5 and 50 nm, said particles being dispersed in a substantially discrete relationship, exposed at a surface of said cold cathode and protruding from the surface of said cold cathode, wherein electrons are emitted from said particles at the surface of said cold cathode.

7. The cold cathode electron source element of claim 6 wherein said cold cathode is prepared by the steps of forming an amorphous or microcrystalline cold cathode-forming conductor layer and effecting heat treatment on the cold cathode-forming conductor layer.

8. The cold cathode electron source element of claim 7 wherein said heat treatment is effected at a temperature in the range from a film depositing temperature to 700° C.

9. The cold cathode electron source element of claim 6, wherein said deposited component to constitute said cold cathode base and said deposited component to constitute said conductive material particles are alternately deposited thin layers to thereby form a cold cathode-forming conductive layer.

10. The cold cathode electron source element of claim 9 wherein said thin layer of a component to constitute said conductive material particles has a thickness of 0.5 nm to 50 nm.

11. The cold cathode electron source element of claim 9 wherein after the cold cathode-forming conductor layer is formed, said cold cathode-forming conductor layer is heat treated at a temperature in the range from a film depositing temperature of said cold cathode-forming conductor layer to 700° C.

* * * * *